US006401277B1

(12) United States Patent
Savage et al.

(10) Patent No.: US 6,401,277 B1
(45) Date of Patent: Jun. 11, 2002

(54) SIDERAIL EXTENDER

(75) Inventors: John Savage, Cincinnati, OH (US); Michael Buccieri, Greenfield, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/522,420

(22) Filed: Mar. 9, 2000

Related U.S. Application Data

(60) Provisional application No. 60/123,938, filed on Mar. 12, 1999.

(51) Int. Cl.[7] ..... A47C 21/08

(52) U.S. Cl. ..... 5/430; 5/425; 5/428

(58) Field of Search ..... 5/424–430, 663

(56) References Cited

U.S. PATENT DOCUMENTS

| | | | | |
|---|---|---|---|---|
| 421,656 | A | 2/1890 | Blanken | |
| 993,119 | A | 5/1911 | Stannard | |
| 2,136,088 | A | 11/1938 | Stevens, Sr. | |
| 2,644,173 | A | 7/1953 | James | |
| 2,710,976 | A | 6/1955 | Martensen | |
| 2,951,252 | A | 9/1960 | Roche | |
| 3,018,492 | A | 1/1962 | Rosen | |
| 3,148,387 | A | 9/1964 | Sarnie, Jr. et al. | |
| 3,321,779 | A | 5/1967 | Kaufman et al. | |
| 3,619,824 | A | 11/1971 | Doyle | |
| 3,742,530 | A | 7/1973 | Clark | |
| 3,877,090 | A | 4/1975 | Schutz | 5/93.1 |
| 4,183,015 | A | 1/1980 | Drew et al. | |
| 4,214,326 | A | 7/1980 | Spann | |
| 4,215,446 | A | 8/1980 | Mahoney | 5/425 |
| 4,232,415 | A | 11/1980 | Webber | 5/427 |
| 4,370,765 | A | 2/1983 | Webber | 5/427 |
| 4,439,880 | A | 4/1984 | Koncelik et al. | 5/429 |
| D276,112 | S | 10/1984 | Ferrell et al. | |
| 4,607,402 | A | 8/1986 | Pollard | 5/425 |
| 4,654,903 | A | 4/1987 | Chubb et al. | 5/108 |
| 4,670,923 | A | 6/1987 | Gabriel et al. | 5/424 |
| 4,672,698 | A | 6/1987 | Sands | 5/424 |
| 4,676,687 | A | 6/1987 | Koffler | 5/430 |
| 4,704,750 | A | 11/1987 | Wheelock | 5/127 |
| 4,710,049 | A | 12/1987 | Chang | 5/99.1 |
| 4,710,992 | A | 12/1987 | Falwell et al. | 5/428 |
| 4,745,647 | A | 5/1988 | Goodwin | 5/713 |
| 4,767,419 | A | 8/1988 | Fattore | 5/428 |
| 4,768,249 | A | 9/1988 | Goodwin | 5/713 |
| 4,783,864 | A | 11/1988 | Turner | 5/424 |
| 4,800,600 | A | 1/1989 | Baum | 5/424 |
| 4,827,545 | A | 5/1989 | Arp | 5/424 |
| 4,872,228 | A | 10/1989 | Bishop | 5/425 |
| 4,873,734 | A | 10/1989 | Pollard | 5/425 |
| 5,010,611 | A | 4/1991 | Mallett | 5/424 |
| 5,035,014 | A | 7/1991 | Blanchard | 5/424 |
| 5,044,025 | A | 9/1991 | Hunsinger et al. | 5/424 |
| 5,077,843 | A | 1/1992 | Dale et al. | 5/185 |
| 5,083,332 | A | 1/1992 | Foster et al. | 5/185 |
| 5,084,925 | A | 2/1992 | Cook | 5/425 |
| 5,097,550 | A | 3/1992 | Marra, Jr. | 5/424 |
| 5,175,897 | A | 1/1993 | Marra, Jr. | 5/425 |
| 5,179,774 | A | 1/1993 | Foster et al. | 5/600 |
| 5,191,663 | A | 3/1993 | Holder et al. | 5/424 |
| 5,381,571 | A | 1/1995 | Gabhart | 5/430 |
| 5,410,765 | A | 5/1995 | Dicken | 5/424 |

(List continued on next page.)

OTHER PUBLICATIONS

Catalog: "A Hill–ROM Solution: Med–Surg Bed Accessories," Hill–Rom, 1997.

*Primary Examiner*—Alexander Grosz
(74) *Attorney, Agent, or Firm*—Bose McKinney & Evans LLP

(57) ABSTRACT

A bed is provided having a bedframe, a mattress positioned on the bedframe, a first siderail, and a second siderail. The first and second siderails cooperate to define a gap therebetween. The bed further includes a siderail extender coupled to the first siderail that extends between the first and second siderails to close the gap defined therebetween.

50 Claims, 15 Drawing Sheets

U.S. PATENT DOCUMENTS

| | | | | |
|---|---|---|---|---|
| 5,421,046 | A | | 6/1995 | Vande Streek ..... 5/663 |
| 5,450,641 | A | | 9/1995 | Montgomery ..... 5/425 |
| 5,455,973 | A | | 10/1995 | Brumfield et al. ..... 5/424 |
| 5,481,772 | A | | 1/1996 | Glynn et al. ..... 5/663 |
| 5,485,699 | A | | 1/1996 | Gabhart ..... 5/425 |
| 5,524,306 | A | | 6/1996 | Georeg ..... 5/424 |
| 5,557,817 | A | | 9/1996 | Haddock ..... 5/425 |
| 5,577,277 | A | | 11/1996 | Sundberg et al. ..... 5/426 |
| 5,642,545 | A | | 7/1997 | Howard ..... 5/663 |
| 5,671,490 | A | | 9/1997 | Wu ..... 5/430 |
| 5,689,839 | A | | 11/1997 | Langaniere et al. ..... 5/425 |
| 5,732,423 | A | | 3/1998 | Weismiller et al. ..... 5/425 |
| 5,749,112 | A | | 5/1998 | Metzler ..... 5/425 |
| 5,761,756 | A | | 6/1998 | Nowak et al. ..... 5/426 |
| 5,771,506 | A | | 6/1998 | Joiner ..... 5/663 |
| 5,781,945 | A | | 7/1998 | Scherer et al. ..... 5/426 |
| 5,802,636 | A | | 9/1998 | Corbin et al. ..... 5/425 |
| 5,864,900 | A | | 2/1999 | Landau ..... 5/424 |
| 5,926,873 | A | | 7/1999 | Fountain ..... 5/424 |
| 6,038,721 | A | * | 3/2000 | Gordon ..... 5/425 |

* cited by examiner

SIDERAIL EXTENDER

This application claims benefit of U.S. Provisional Application Ser. No. 60/123,938 filed Mar. 12, 1999, the disclosure of which is expressly incorporated by reference herein.

BACKGROUND AND SUMMARY OF THE INVENTION

The present invention relates to beds, and particularly to siderails for hospital beds or patient-care beds. More particularly, the present invention relates to beds having barriers such as headboards, footboards, or siderails.

Many hospital beds have siderails positioned to restrain the movement of a person lying on the sleeping surface. The sleeping surfaces of such beds can often be manipulated to adjust the position of the person on the sleeping surface. The siderails of these hospital beds can typically be moved to a position away from the sleeping surface to permit movement of the person on the sleeping surface from the supine position on the sleeping surface to a standing position on the floor near the bed. Conventional hospital beds include several siderails which are paired with various deck sections. This arrangement creates gaps between adjacent siderails.

According to the present invention, a bed is provided having a bedframe, a first barrier coupled to the bedframe, a second barrier coupled to the bedframe, a mattress positioned on the bedframe, and a third barrier pivotably coupled to the first barrier. The first and second barriers cooperate to define a gap therebetween. The third barrier pivots about a horizontal axis of rotation and closes the gap between the first and second barriers.

According to the presently preferred embodiment of the present invention, the third barrier is biased into sliding contact with the second barrier. Furthermore, the third barrier is made of a rigid material.

According to another embodiment of the present invention, a bed is provided having a bedframe, a first siderail coupled to the bedframe, a second siderail coupled to the bedframe, a mattress positioned on the bedframe, and a barrier pivotably coupled to the first siderail and positioned over the first and second siderails. The first and second siderails move relative to one another and cooperate to define a gap therebetween that is filled by the barrier. The barrier has a length that is less than the overall length of the first and second siderails.

Additional features of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
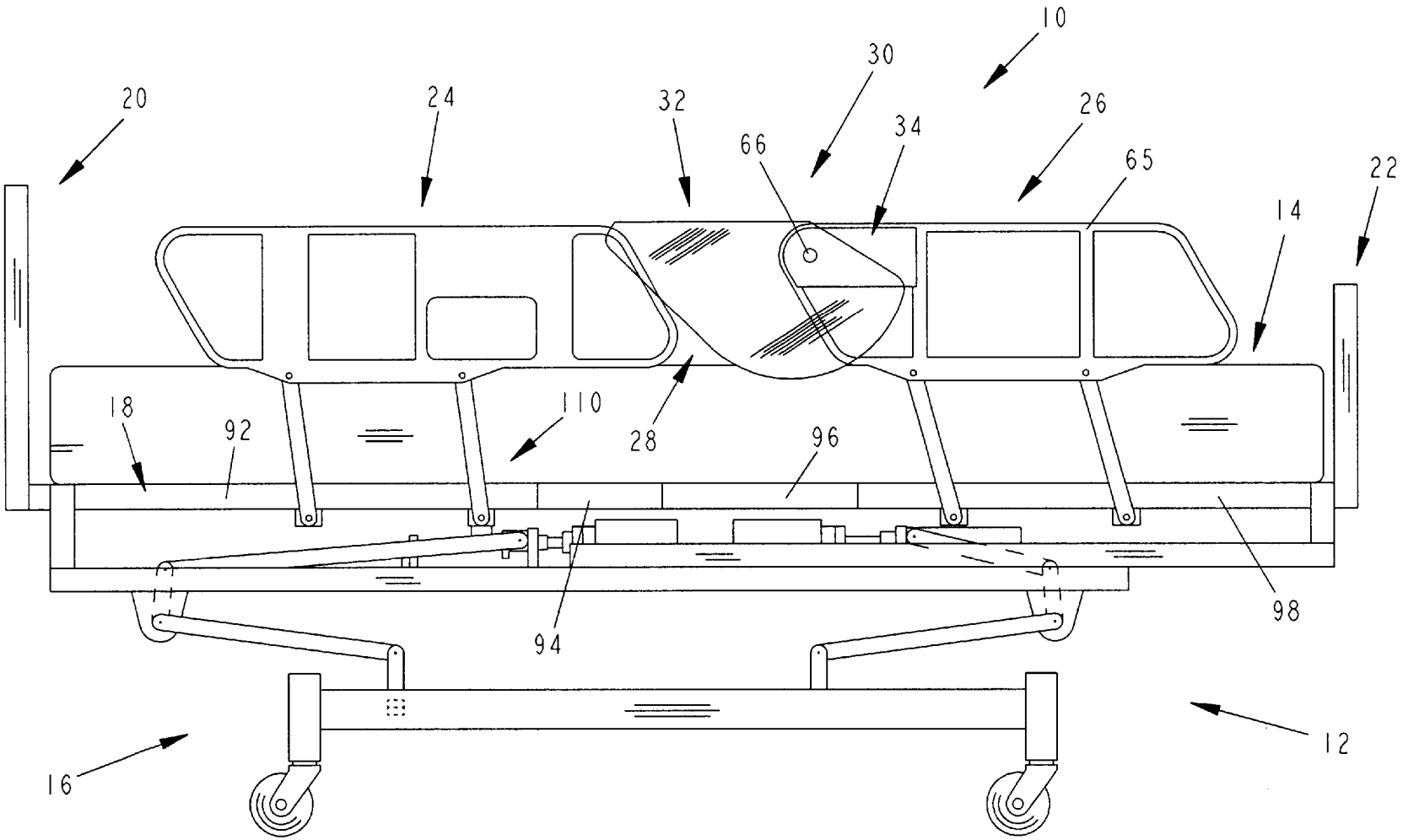
FIG. 1 is a side elevation view of a hospital bed showing the bed including a pair of siderails cooperating to define a gap therebetween and a siderail extender positioned over a portion of the siderails to close the gap.

As shown in FIG. 1, a hospital bed 10 is provided that includes a bedframe 12 and a mattress 14 positioned on bedframe 12. Bedframe 12 includes a deck support 16 and a deck 18 positioned on deck support 16 that supports mattress 14. Bed 10 further includes several barriers, such as a headboard 20 coupled to a head end of bedframe 12, a footboard 22 coupled to a foot end of deck 18, a pair of head end siderails 24 pivotably coupled to deck 18, and a pair of foot end siderails 26 pivotably coupled to deck 18. Each pair of head and foot end siderails 24, 26 cooperate to define a gap 28 therebetween. According to a first embodiment of the present disclosure, hospital bed 10 further includes a pair of siderail extenders 30 positioned over a portion of each set of siderails 24, 26. Siderail extenders 30 are barriers that fill or close gap 28 as shown in FIG. 1.

Figure 2:
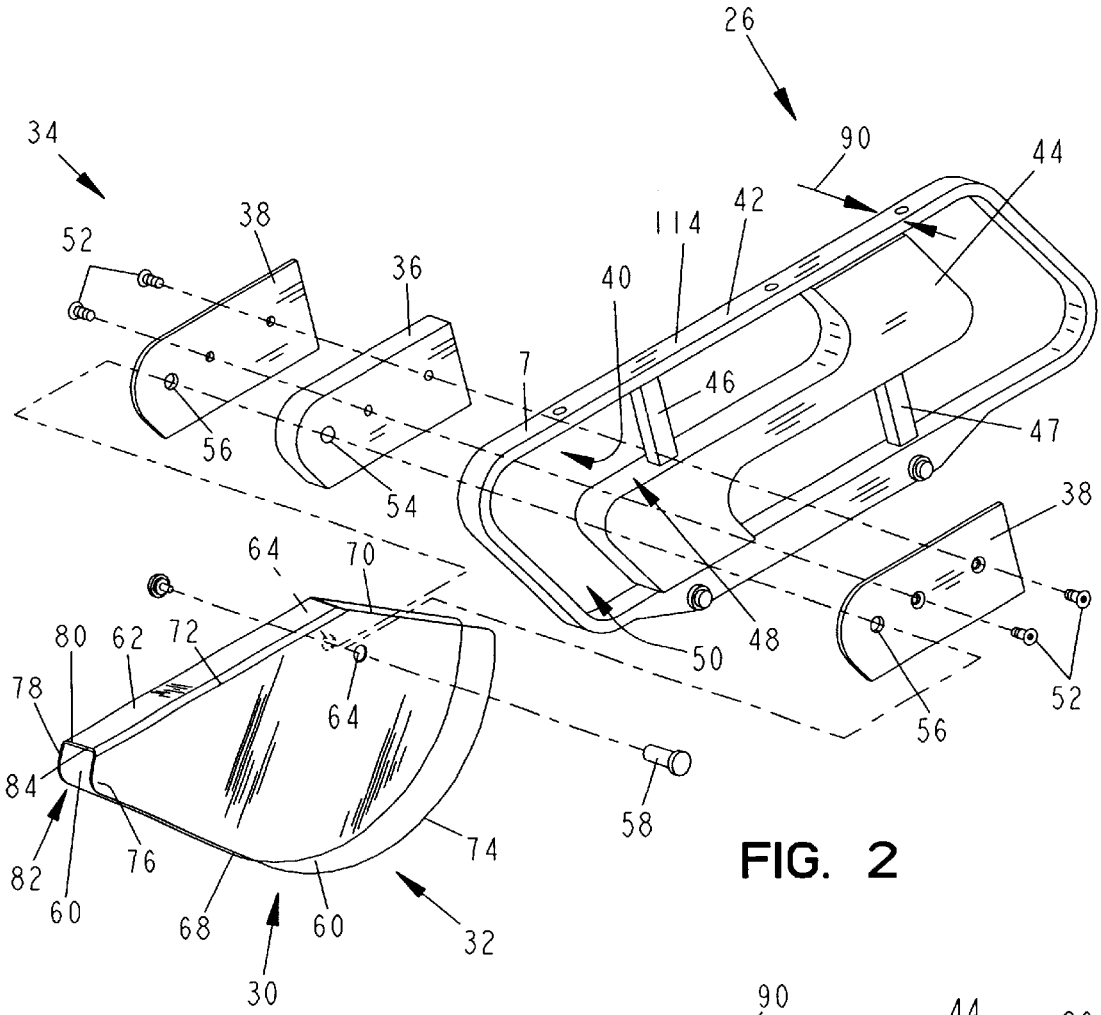
FIG. 2 is an exploded perspective view of a preferred siderail and the siderail extender according to one embodiment of the present disclosure including a saddle-shaped siderail bridge and a bridge coupler including three plates.

Siderail extender 30, as shown in FIG. 2, includes a bridge 32 extending from foot end siderail 26 to head end siderail 24 and a bridge coupler 34 pivotably coupling bridge 32 to foot end siderail 26. Bridge coupler 34 includes a center plug 36 and two opposed side plates 38, as shown in FIG. 2. Center plug 36 is configured to fit within foot end siderail 26. According to alternative embodiments, the siderail extenders are coupled to the head end siderails and extend to the foot end siderails. According to other alternative embodiments, the siderail extenders extend from either siderail to the footboard or headboard, or from the headboard or footboard to the siderails to fill or close the gaps defined therebetween.

Siderail 26 defines an opening 40 in which center plug 36 is positioned. As shown in FIG. 2, siderail 26 includes a perimeter rail member 42, a rail body 44, and a pair of rail struts 46, 47 extending from perimeter rail member 42 to rail body 42. The rail member 42, rail body 44, and rail strut 46 cooperate to define opening 40. As shown in FIG. 2, opening 40 has an upper portion 48 and a lower portion 50. Center plug 36 is positioned in upper portion 48.

Center plug 36 is held in place by positioning it within opening 40 and coupling side plates 38 on both sides thereof using any suitable mechanical fasteners such as screws 52. The shape of center plug 36 is complementary to the shape of upper portion 48 of opening 40 to secure side plates 38 in a fixed manner with respect to siderail 26. Accordingly, the shape of the center plug can be modified as necessary to be compatible with different siderail configurations.

Side plates 38 are dimensioned slightly larger than upper portion 48 of opening 40 so as to overlap enough structure, e.g. perimeter rail member 42, rail strut 46, and rail body 44 to secure bridge coupler 34 thereon. According to an alternative embodiment, one of the side plates is integrally formed with the center plug. Furthermore, according to another alternative embodiment, the bridge is directly coupled to the siderail or another barrier, having appropriately positioned support structure, with an appropriate fastener.

As previously mentioned, bridge coupler 34 pivotably couples bridge 32 to siderail 26. Center plug 36 and side plates 38 each include aligned through-holes 54, 56. Aligned through-holes 54, 56 are provided to receive a pivot pin or rod 58 which is used to pivotally couple bridge 32 to bridge coupler 34.

Figure 3:
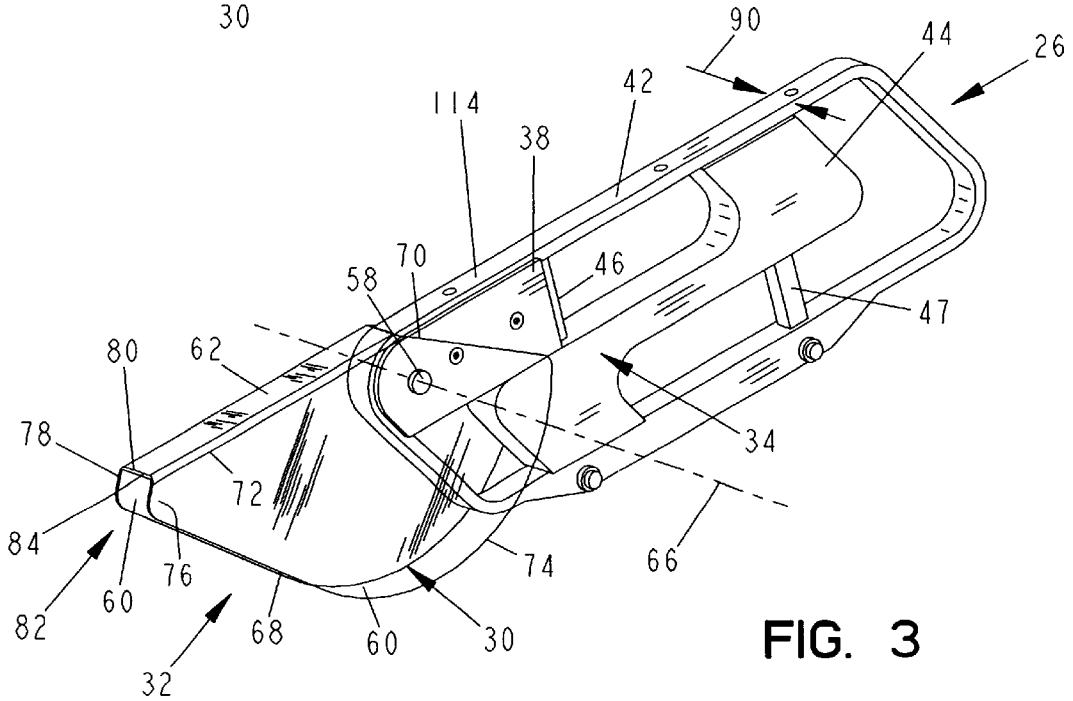
FIG. 3 is a perspective view of the siderail extender of FIG. 1 coupled to the siderail of FIG. 2.

Bridge 32 comprises a saddle-shaped member including two parallel side walls 60 which extend from a common end or top wall 62. Bridge 32 includes aligned through holes 64 in each of side walls 60 which are provided to receive pivot pin 58. Side walls 60 are positioned on opposite sides of siderails 24, 26 so that one side wall 60 is positioned adjacent inner surfaces of siderails 24, 26 that face mattress 14 and one side wall 60 is positioned adjacent outer surfaces of siderails 24, 26 that face away from mattress 14. Although FIG. 3 depicts top wall 62 of bridge 32 as being parallel to an upper surface 114 of perimeter rail member 42 of siderail 26, bridge 32 is free to pivot about a horizontal axis of rotation 66 throughout a range of motion which is limited when top wall 62 contacts a portion of perimeter rail member 42 of siderail 26.

Figure 4:
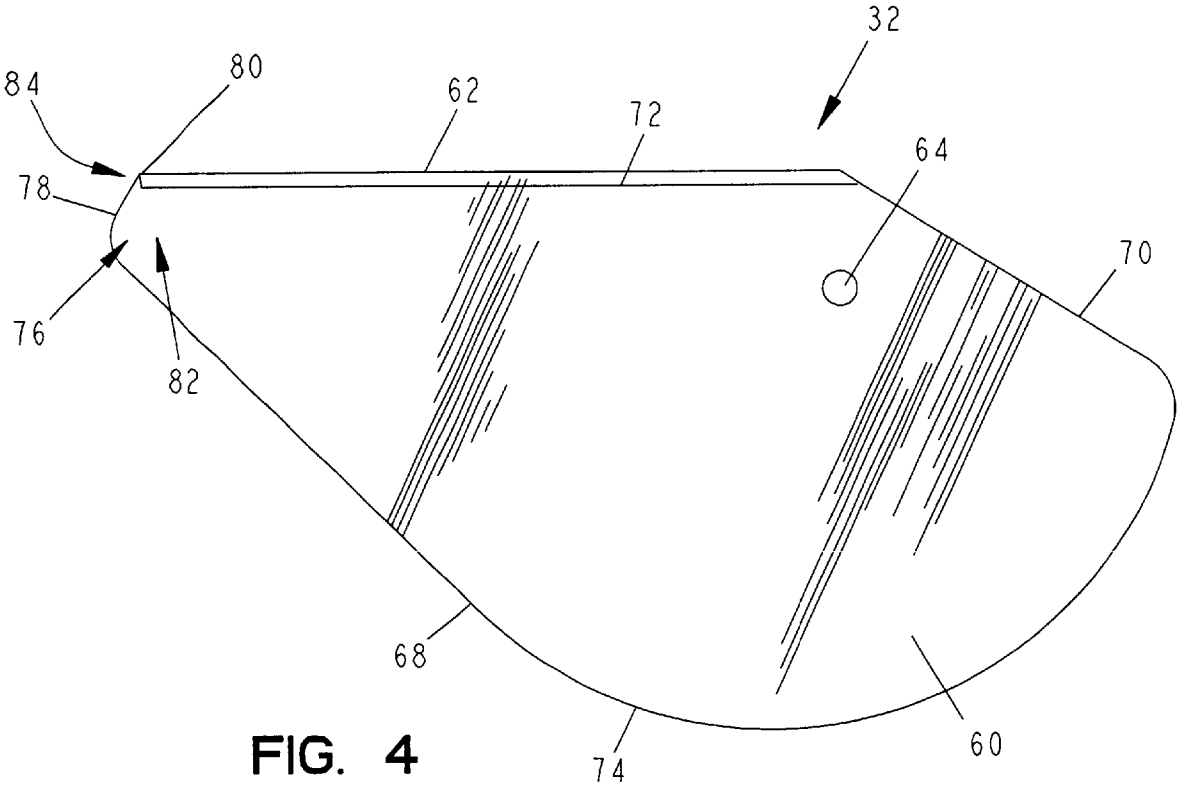
FIG. 4 is a side elevation view of the siderail bridge of the siderail extender of FIG. 1.

As shown in FIG. 4, parallel side walls 60 have the general shape of a parallelogram with the base (opposed to the common end or top wall 62) having a circular or elliptical curved shape as depicted. Each side wall 60 includes a pair of parallel straight edges 68, 70, a substantially straight top edge 72 coupled to top wall 62, and a curved lower edge 74 having either a substantially uniform radius of curvature, an elliptical curvature, or any other curvature. This general shape, as described below, allows bridge 32 to close gaps 28 between adjacent siderails 24, 26 and maintain closure of gap 28 as deck 18 and associated siderails 24, 26 are articulated through various positions as discussed in greater detail below.

Side walls 60 also include a pair of ear portions 76 distant from through holes 64. These ear portions 76 are defined by a portion of straight edge 68 and a tapered edge 78 extending from straight edge 68 to top edge 72. Ear portions 76 extend beyond a free end 80 of top wall 62 to define a notch 82 in bridge 32 as best shown in FIG. 2. Thus, free end 80 of top wall 62 terminates at a distal or leading edge 84 which is recessed between or setback from ear portions 76 of sidewalls 60.

Bridge 32 is made from a transparent material such as a plastic material. According to alternative embodiments, the bridge is made from a semi-transparent, opaque or non-transparent material. The bridge may also be made of any suitably rigid material, including plastics or metals.

Figure 5:
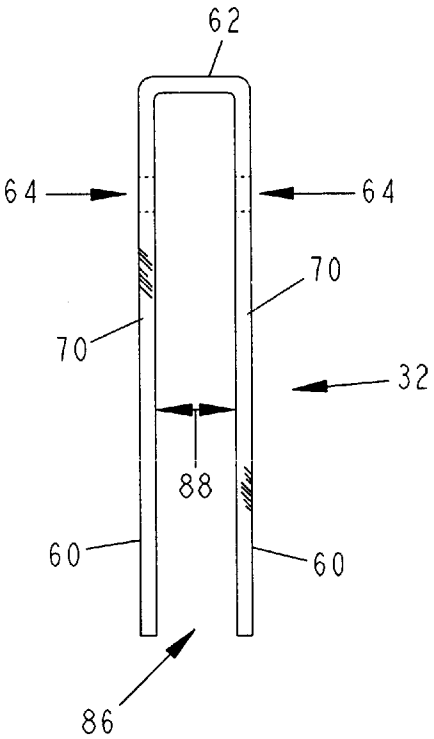
FIG. 5 is an end view of the siderail bridge of FIG. 1.

As shown in FIG. 5, sidewalls 60 and top wall 62 of bridge 32 cooperate to define a channel 86 sized to receive portions of head and foot end siderails 24, 26. Channel 86 has a width 88 that is slightly larger than a width 90 of siderails 24, 26. The difference provides clearance between sidewalls 60 and siderails 24, 26 so that bridge 32 pivots freely about foot end siderail 26 and slides and pivots relative to head end siderail 24 during articulation of deck 18 as will be described in further detail below.

Bridge 32 includes substantially uniform right and left halves. Thus, each bridge 32 can be mounted on either the right or left foot end siderails 26.

Figure 6:
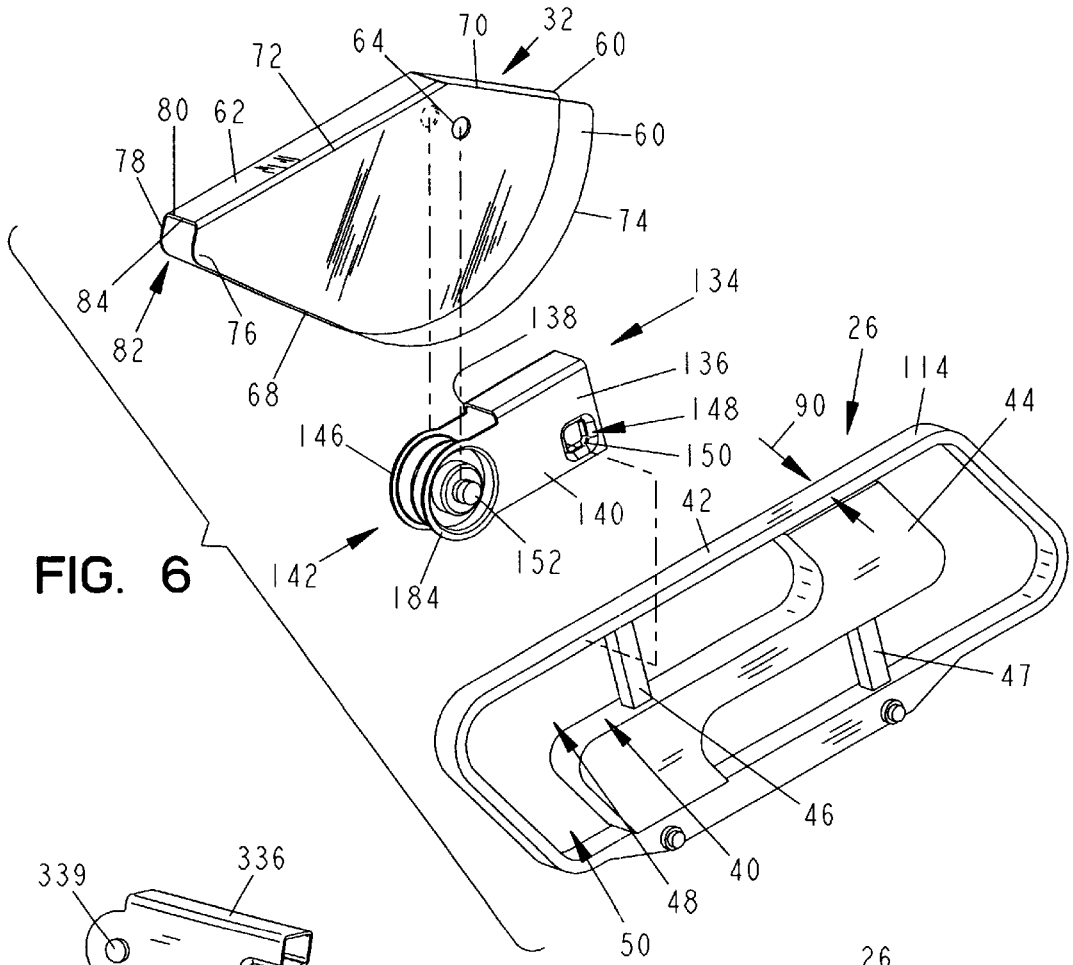
FIG. 6 is an exploded perspective view of a siderail extender according to another embodiment of the present disclosure including the saddle-shaped bridge of FIG. 1 and an alternative bridge coupler.

An alternative embodiment bridge coupler 134 is shown in FIG. 6. Bridge coupler 134 comprises a saddle-shaped member 136 sized to fit over perimeter rail member 42 of siderail 26. Saddle-shaped member 136 includes a rail-receiving channel 138 and two opposed side walls 140 extending from rail-receiving channel 138.

Bridge coupler 134 further includes a bearing pivot hub 142 coupled to one end of saddle-shaped member 136. Bearing pivot hub 142 includes two aligned bearing pivot hub halves 144, 146 located on either side wall 140 of saddle-shaped member 136. Side walls 140 are provided with cooperating latch or catch structures 148 which are aligned to engage one another. Catch structures 148 include opposed resilient latch fingers 150 which engage one another. In alternative embodiments, other mechanical engaging structures or fasteners could be used to couple the side walls of the saddle-shaped member together when the bridge coupler is attached to a siderail.

Bridge coupler 134 is coupled to siderail 26 by spreading side walls 140 outwardly at their lower edges and sliding saddle-shaped member 136 over perimeter rail member 42 so that each side wall 140 passes by opposite sides of perimeter rail member 42. Once side walls 140 pass below perimeter rail member 42, they move towards each other so that catch structures 148 engage one another. Catch structures 148 are aligned and configured to abut rail strut 46 and thus help maintain the lateral positioning of bridge coupler 134.

Bearing pivot hub halves 144, 146 include pivot projections 152 that extend into through holes 64 of bridge 32. Bearings (not shown) within the bearing pivot hub halves 144, 146 permit free rotation of pivot projections 152 permitting bridge 32 to pivot about horizontal axis of rotation 66.

Figure 7:
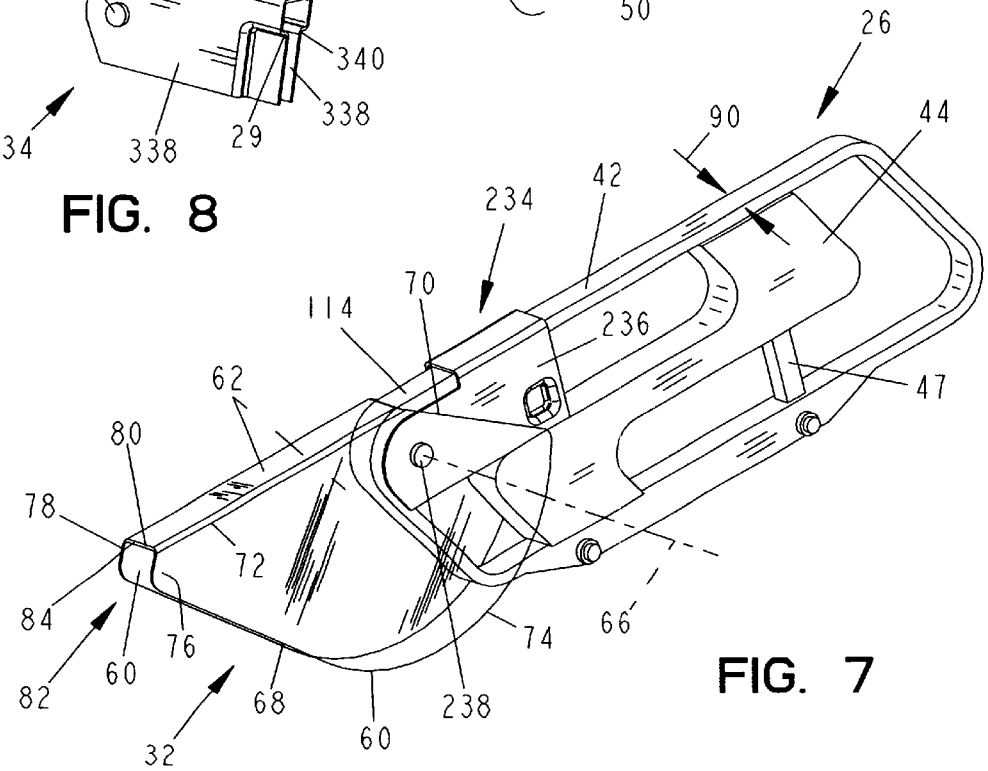
FIG. 7 is a perspective view of another alternative siderail extender coupled to the siderail of FIG. 2.

Another alternative embodiment bridge coupler 234 is shown in FIG. 7. Bridge coupler 234 includes a saddle-shaped member 236 similar to saddle-shaped member 136 of bridge coupler 134 and a pair of aligned pivot projections 238 coupled to saddle-shaped member 236. Pivot projections 238 extend into through holes 64 of bridge 32 to permit pivoting of bridge 32 about horizontal axis of rotation 66.

Figure 8:
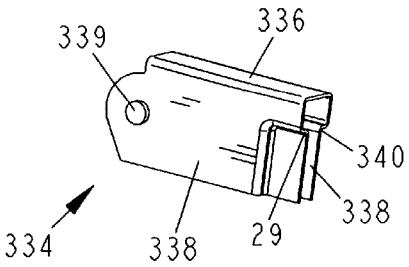
FIG. 8 is a perspective view of a bridge coupler according to one embodiment of the present disclosure.

Another alternative embodiment bridge coupler 334 is shown in FIG. 8. Bridge coupler 334 includes a saddle-shaped member 336 having a pair of side walls 338. Sidewalls 338 include compound stepped portions 340 which are configured to receive and abut rail strut 46 of siderail 26, and engage perimeter rail member 42. Bridge coupler 334 is coupled to siderail 26 by spreading apart compound stepped portions 340 and sliding side walls 338 of bridge coupler 334 over and/or along perimeter rail member 42 until compound stepped portions 340 engage rail strut 46.

Bridge coupler 334 further includes aligned pivot projections 339 similar to pivot projections 238 of bridge coupler 238. Pivot projections 339 are positioned in through holes 64 of bridge 32 to permit pivoting about horizontal axis of rotation 66. According to an alternative embodiment, pivot hubs are incorporated in the bridge coupler to permit pivoting of bridge 32.

FIGS. 9–14 diagrammatically depict various exemplary positions of articulated bed 10 having diagrammatic siderails 24, 26 and siderail extender 30 according to the present disclosure, pivotably coupled to siderail 26 to close gap 28 between siderails 24, 26. Throughout FIGS. 9–14, common reference numbers are used to identify common elements.

Although not limited for use in conjunction with any particular type of beds, the present invention is particularly useful in conjunction with beds having articulated decks. Articulating deck 18 includes a head section 92, a seat section 94, a thigh section 96, and a foot section 98. Mattress 14 is normally positioned on deck 18 to define a patient support surface and includes head, seat, thigh, and foot sections, each of which generally corresponds to the like-named portions of articulating deck 18, and each of which is generally associated with the head, seat, thighs, and feet of a person lying on the patient support surface.

Articulating deck 18 can be raised and lowered and can assume a range of positions which are exemplified diagrammatically in FIGS. 9–14, using conventional mechanisms. For example, a suitable articulating deck and deck support is disclosed in U.S. Pat. Nos. 4,559,655 to Beck and 5,715,548 to Weismiller et al., which are expressly incorporated by reference herein.

Each pair of head and foot end siderails 24, 26 are pivotably mounted on opposite sides of bed 10. Head end siderails 24 are mounted so as to move with head section 92 of articulating deck 18 and foot end siderails 26 are mounted so as to move with foot section 98 of articulating deck 18.

Figure 15:
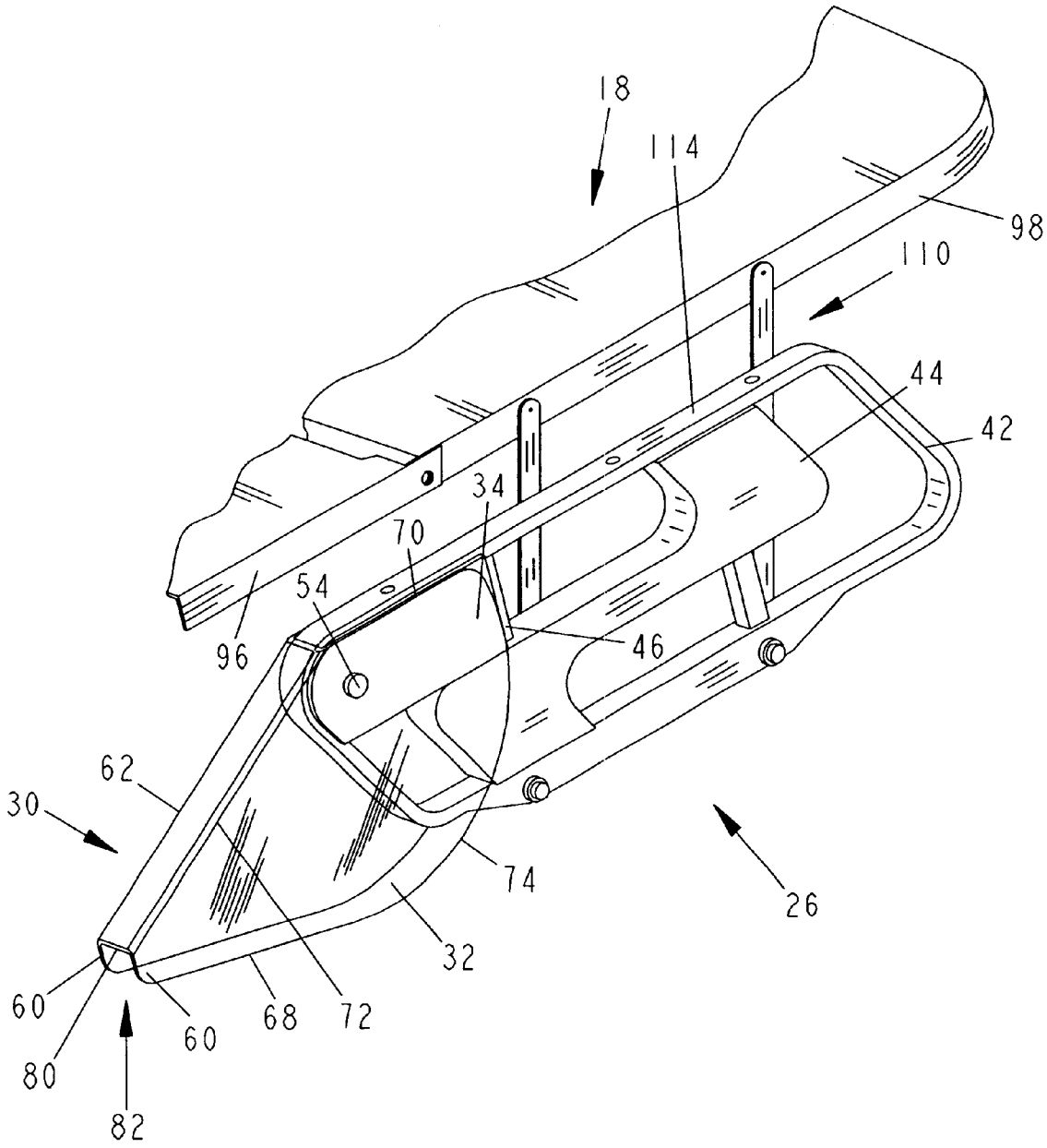
FIG. 15 is a perspective view of the siderail extender of FIG. 1 attached to the foot end siderail.

Head and foot end siderails 24, 26 are mounted so that a caregiver can lower siderails 24, 26 from an up position, as shown in FIG. 1, to a down position, as shown in FIG. 15. Mechanisms for providing such raising and lowering of head and foot end siderails 24, 26 are conventional and depicted schematically as siderail mounting mechanisms 110. According to the presently preferred embodiment, the mechanisms are clock-type swing mechanisms that swing the head end siderail toward the head end of the bed and the foot end siderail to the foot end of the bed. According to alternative embodiments, other types of mechanisms are used to raise and lower the siderails.

Figure 9:
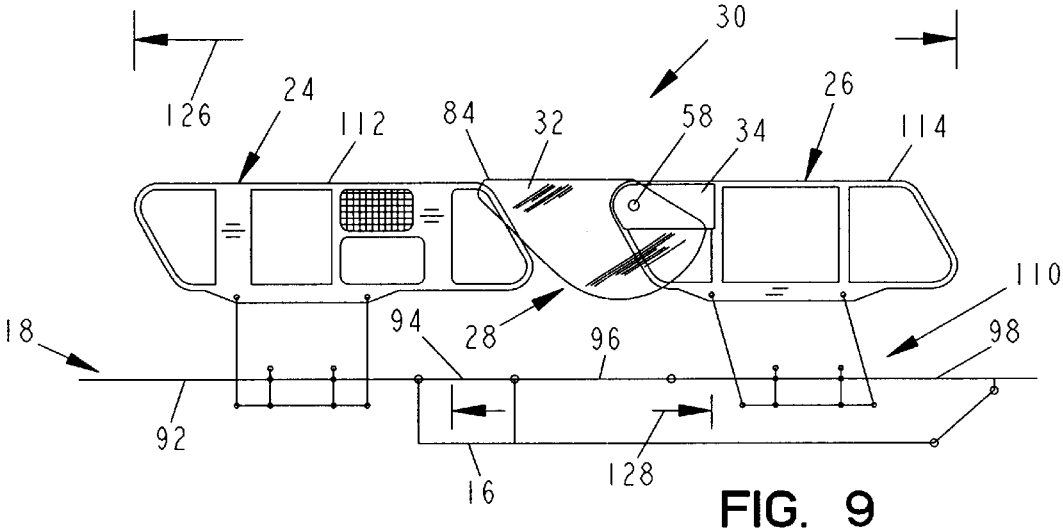
FIG. 9 is a diagrammatic view of the bed with a bed deck in a flat position showing the siderail bridge positioned over the foot end siderail and head end siderail.

Bed 10 is configured to move to a flat position as shown in FIG. 9. While in the flat position, upper surfaces 112, 114 of head and foot end siderails 24, 26 are substantially coplanar or level with one another. Bridge 32 extends from foot end siderail 24 to head end siderail 26 to close or bridge gap 28 between head and foot end siderails 24, 26. In this position, bridge 32 is pivotably supported by pin 58 on foot end rail 26 and by leading edge 84 on a foot end of head end rail 24. Head and foot end siderails 24, 26 and siderail extender 30 form a continuous set of barriers or restraints. As shown in FIG. 9, siderails 24, 26 cooperate to define a siderail length 126 measured from a head end of head end siderail 24 to a foot end of foot end siderail 26. Bridge 32 has a length 128 that is less than siderail length 126.

Figure 10:
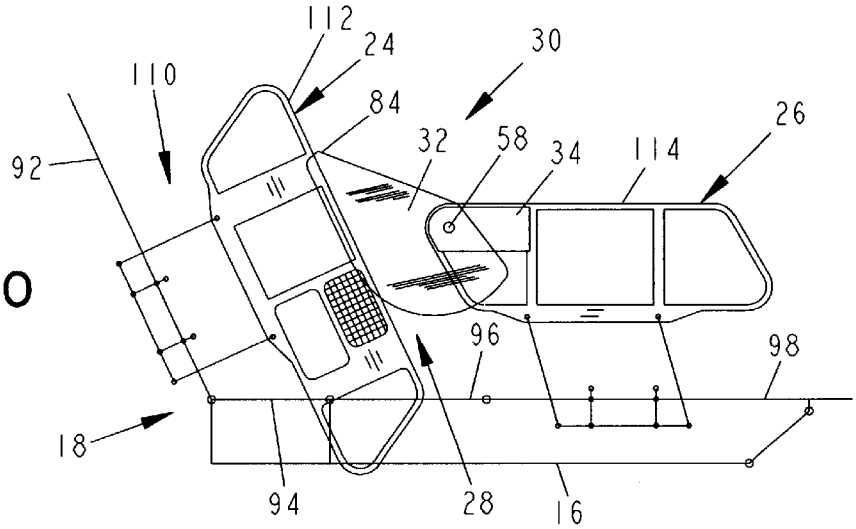
FIG. 10 is a diagrammatic view of the bed in a position in which a head section of the bed deck is pivoted upward and seat, thigh, and foot sections of the bed deck are flat.

FIG. 10 is a diagrammatic view of bed 10 in a position in which head section 92 of deck 18 is pivoted upward and seat, thigh, and foot sections 94, 96, 98 of deck 18 are flat. When bed 10 is in this position, a patientlying on bed 10 may sit up. In this position, bridge 32 of siderail extender 30 remains extended across to close or bridge gap 28 between head and foot end siderails 24, 26 as depicted. In FIGS. 9 and 10, bridge 32 is supported at axis of rotation 66 and by leading edge 84, and head and foot end siderails 24, 26 and siderail extender 30 form a continuous set of barriers or restraints.

When moving articulating deck 18 and head and foot end siderails 24, 26 between the positions depicted in FIGS. 9 and 10 (and between any of the positions depicted in FIGS. 9–14), leading edge 84 of bridge 32 of siderail extender 30 pivots and slides along upper surface 112 of head end siderail 24 as bridge 32 pivots about axis of rotation 66 relative to siderail 26. At the same time, ear portions 76 of bridge 32 straddle either side of siderail 24 so as to guide the movement of leading edge 84 along upper surface 112 of siderail 24 so that top wall 62 continues to cover head and foot end siderails 24, 26.

The cooperation between the pivoting of bridge 32 about axis of rotation 66 and the pivoting and sliding movement of leading edge 84 of bridge 32 along siderail 24 allows siderail extender 30 to extend across and close or bridge gap 28 between head and foot end siderails 24, 26 throughout movement of articulating deck 18 and head and foot end siderails 24, 26 in any of the positions exemplified in FIG. 9–14. Thus, when head end siderail 24 moves relative to foot end siderail 26 due to movement of head end siderail 24, movement of foot end siderail 26, or movement of both head and foot end siderails 24, 26, bridge 32 continues to close gap 28.

Head and foot end siderails 24, 26 cooperate to define a plane in which siderails 24, 26 move during articulation of deck 18 through the positions shown in FIGS. 11–14. Bridge 32 rotates about axis of rotation 66 within the plane during relative movement of siderails 24, 26.

Figure 11:
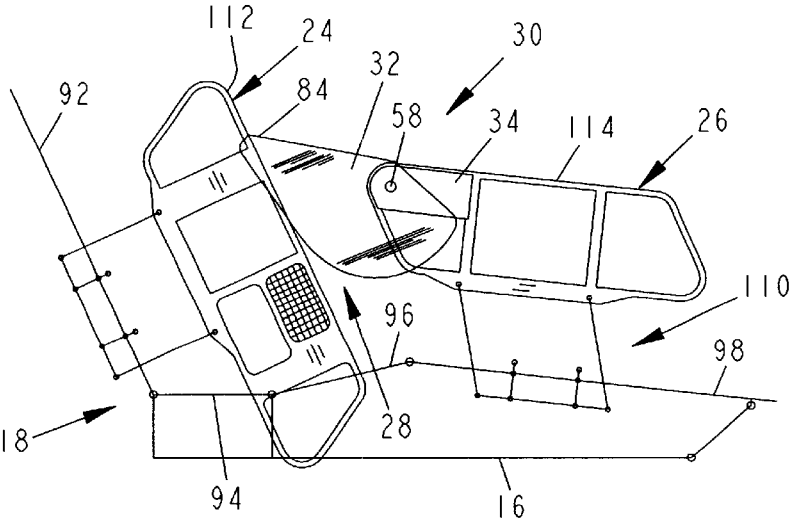
FIG. 11 is a diagrammatic view of the bed in a position in which the head section of the bed deck is pivoted upwardly, as in FIG. 10, and the foot section of the bed deck is slightly elevated.

FIG. 11 is a diagrammatic view of bed 10 in a position in which head section 92 of deck 18 is pivoted in the plane upwardly as in FIG. 10 and foot section 98 of deck 18 is slightly elevated. The position of bed 10 depicted in FIG. 11 permits a patient lying on bed 10 to sit up with his or her legs slightly elevated.

Figure 12:
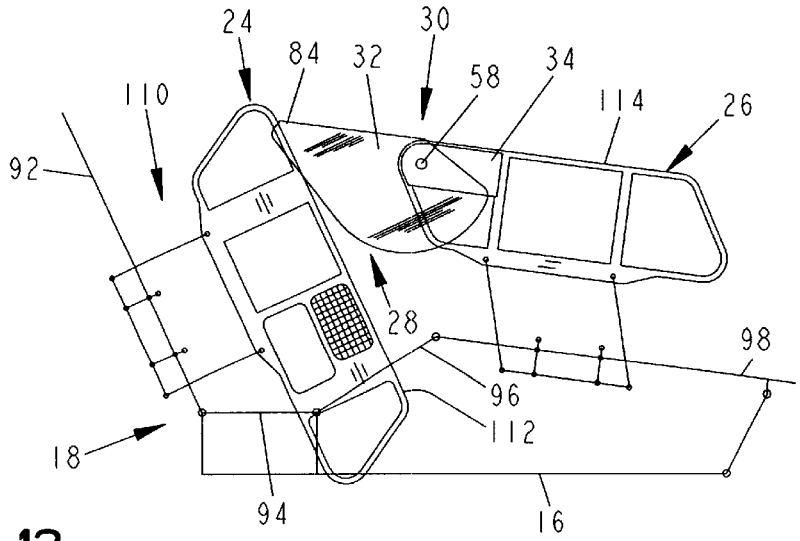
FIG. 12 is a diagrammatic view of the bed in a position in which the head section of bed deck is pivoted upwardly, as in FIG. 10, and the foot section of the bed deck is elevated.

FIG. 12 is a diagrammatic view of bed 10 in a position in which head section 92 of deck 18 is pivoted upwardly in the plane as in FIG. 10 and foot section 98 of deck 18 is elevated. The position of bed 10 depicted in FIG. 12 permits a patient lying on bed 10 to sit up with his or her legs more elevated than in FIG. 11. As shown, leading edge 84 is now positioned adjacent the head end of head end siderail 24.

Figure 13:
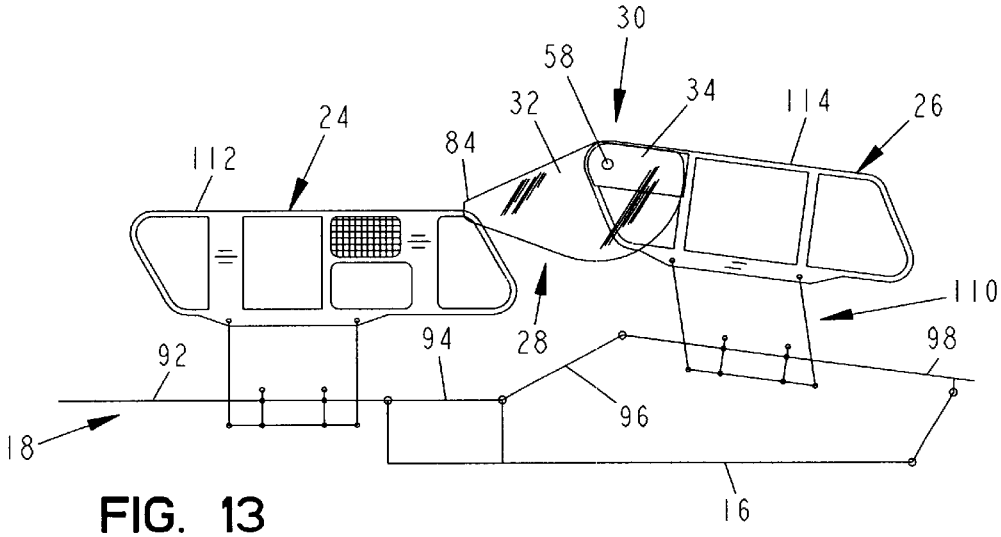
FIG. 13 is a diagrammatic view of the bed in a position in which the foot section of bed deck is elevated, as in FIG. 12, and the head section of the deck is substantially flat.

FIG. 13 is a diagrammatic view of bed 10 in a position in which foot section 98 of deck 18 is elevated as in FIG. 12 and head section 92 of deck 18 is substantially flat. The position of bed 10 depicted in FIG. 13 permits a patient lying on bed 10 to only have his or her legs elevated.

Figure 14:
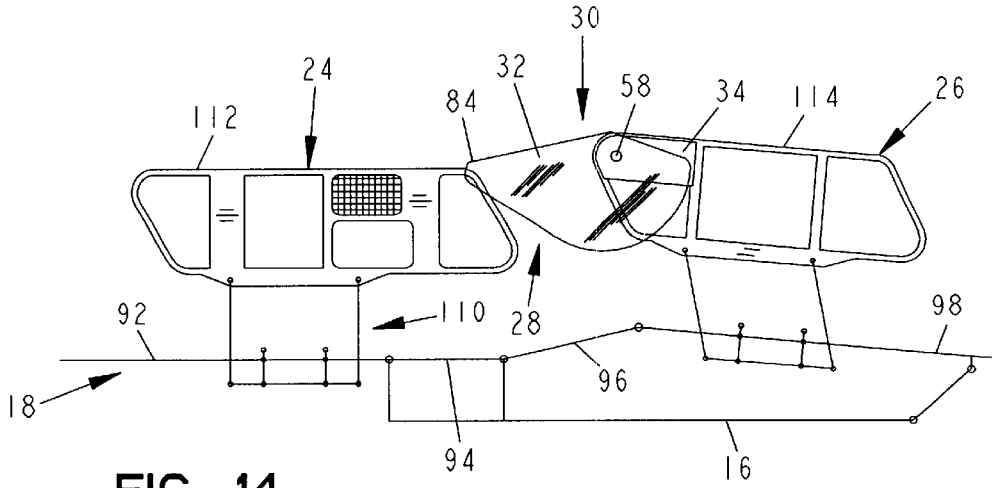
FIG. 14 is a diagrammatic view of the bed in a position in which the foot section of the bed deck is slightly elevated, as in FIG. 11, and the head section of the deck is substantially flat.

FIG. 14 is a diagrammatic view of bed 10 in a position in which foot section 98 of deck 18 is slightly elevated as in FIG. 11 and head section 92 of deck 18 is substantially flat. The position of bed 10 depicted in FIG. 14 permits a patient lying on bed 10 to have his or her legs elevated at a lesser degree than in FIG. 13.

FIGS. 9–14 exemplify various positions into which articulating deck 18 can be moved for patient treatment and comfort and corresponding positions of head and foot end siderails 24, 26. In each of the positions exemplified in FIGS. 9–14 and other possible positions which articulated deck 18 can assume, bridge 32 of siderail extender 30 moves in the plane and remains extended between siderails 24, 26 to close or bridge gap 28 as depicted. Thus, once positioned so as to bridge across gap 28 formed between two adjacent siderails, bridge 32 of the present disclosure is capable of remaining in position as articulated deck 18 and head and foot end siderails 24, 26 are moved into different configurations. Although the operation of siderail extender 30 has been described with reference to adjacent head and foot end siderails 24, 26, it is to be understood that siderail extender 30 of the present disclosure could be used in conjunction with any adjacent siderails or other barriers.

When both siderails 24, 26 are in the up position, bridge 32 can be lifted or pivoted about axis of rotation 66 so that leading edge 84 of bridge 32 is spaced apart from head end siderail 24. Even though leading edge 84 is spaced apart from head end siderail 24, side walls 60 continue to close gap 28.

FIG. 15 is a perspective view of siderail extender 32 and siderail 26 in their lowered position relative to articulating deck 18. Upper surface 114 of siderail 26 is below foot section 98 of articulating deck 18. Typically, siderail 26 is moved in a clockwise pivotal motion until upper surface 114 of siderail 26 is below the level of the corresponding section of articulating deck 18. Thereafter, mounting mechanism of siderail 26 permits siderail 26 to be moved to a position beneath the corresponding section of articulating deck 18 so that siderail 26 is out of the way.

When in the storage position, leading edge 84 is positioned below upper surface 114 of foot end siderail 26 and away from upper surface 112 of head end siderail 24. This orientation permits siderail extender 30 to be positioned or stored in a storage position out of the way so that a patient lying on bed 10 is not restrained by siderail extender 30 and so that care givers can access the patient. Furthermore, when the siderail extender 30 is in the storage position, siderails 24, 26 are free to pivot between the raised and stored position without interference therebetween.

Figure 16:
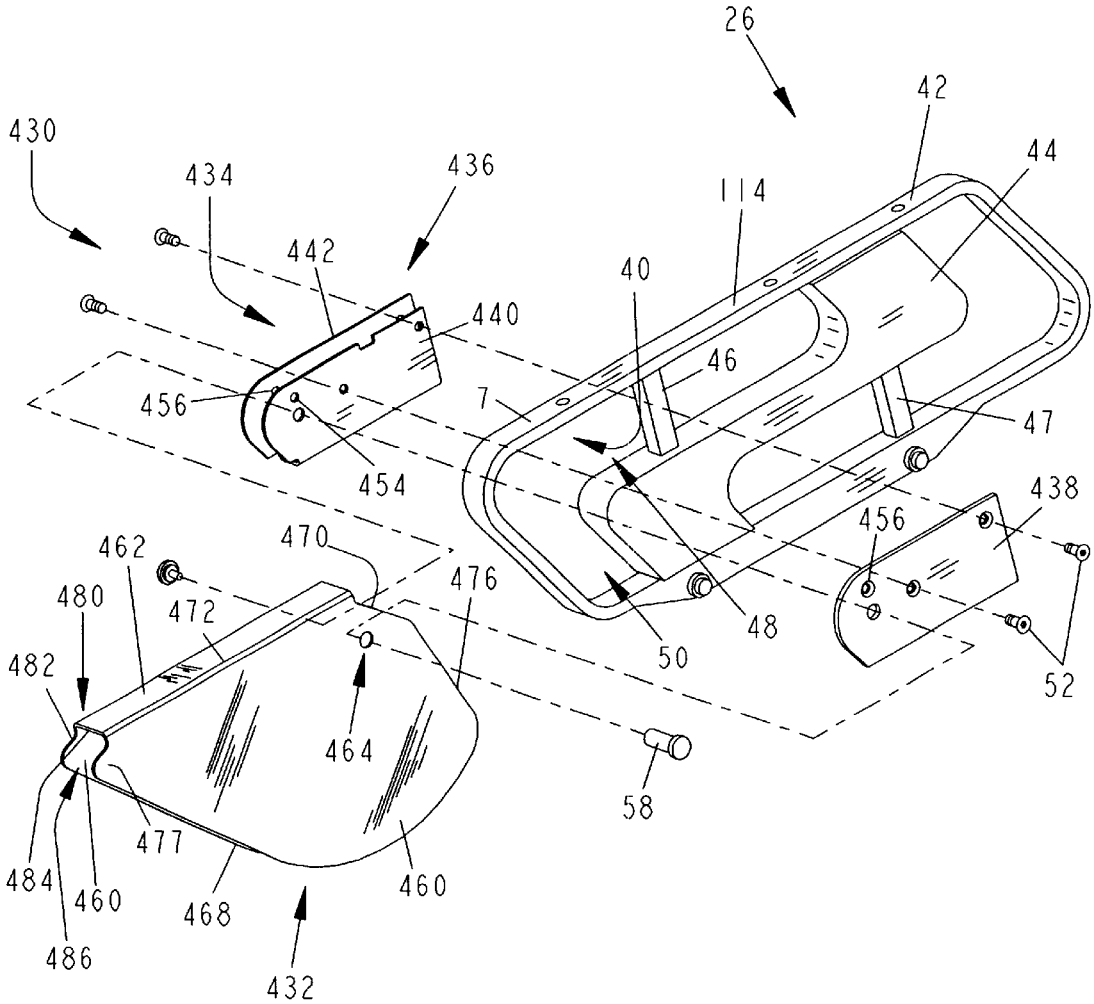
FIG. 16 is an exploded perspective view of the foot end siderail and a siderail extender according to yet another embodiment of the present disclosure including a saddle-shaped bridge and a bridge coupler including a saddle-shaped member, and a plate.

A siderail extender 430 according to a second embodiment of the present disclosure is provided in FIG. 16. Siderail extender 430 includes abridge 432 and a bridge coupler 434 pivotably coupling bridge 432 to foot end siderail 26. Bridge coupler 434 includes a saddle-shaped member 436 and a side plate 438. Saddle-shaped member 436 includes a center plug portion 440 configured to fit within upper portion 48 of opening 40 of foot end siderail 26 and a side plate 442 coupled to center plug portion 440. Side plate 442 is substantially similar to side plate 438.

Center plug portion 436 is held in place by positioning it within opening 40 and coupling side plate 438 on one side thereof so that side plate 442 covers one side of upper portion 48 of opening 40 and side plate 438 covers the other side of upper portion 48. Any suitable mechanical fasteners such as screws 52 are then used to couple side plate 438 to center plug portion 440 of saddle-shaped member 436.

The shape of center plug portion 440 is complementary to the shape of upper portion 48 of opening 40 to secure side plates 438, 442 in a fixed manner with respect to siderail 26. Side plates 438, 442 are dimensioned slightly larger than upper portion 48 of opening 40 so as to overlap enough structure, e. g. perimeter rail member 42, rail strut 46, and rail body 44 to secure bridge coupler 434 thereon.

As previously mentioned, bridge coupler 434 pivotably couples bridge 432 to siderail 26. Center plug portion 440 and side plates 438, 442 each include aligned through holes 454, 456. Aligned through holes 454, 456 are provided to receive pivot pin 58 which is used to pivotally couple bridge 432 to bridge coupler 434.

Bridge 432 comprises a saddle-shaped member including two parallel side walls 460 which extend from a common end or top wall 462. Bridge 432 includes aligned through holes 464 in each of side walls 460 which are provided to receive pivot pin 58.

Figure 20:
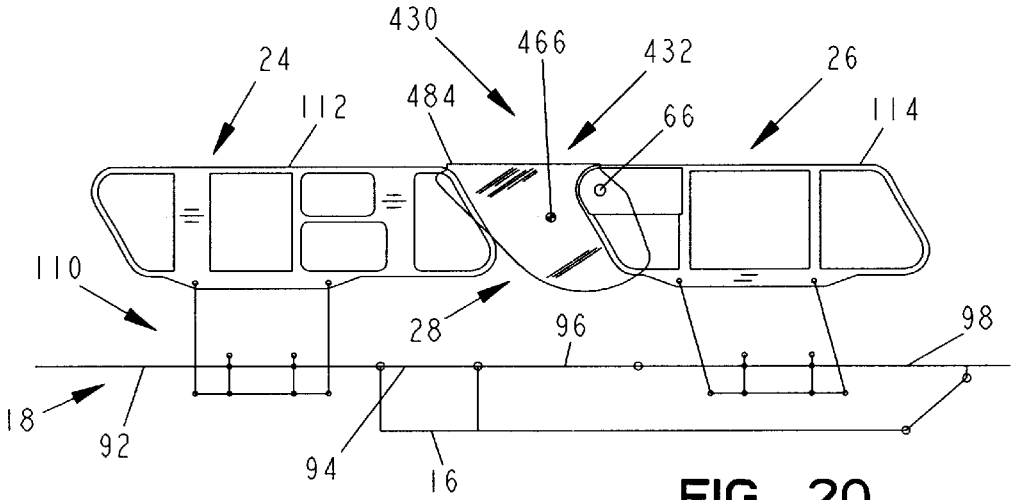
FIG. 20 is a diagrammatic view of the bed with the bed deck in the flat position showing the siderail bridge of FIG. 16 positioned over the foot end siderail and head end siderail.
Figure 21:
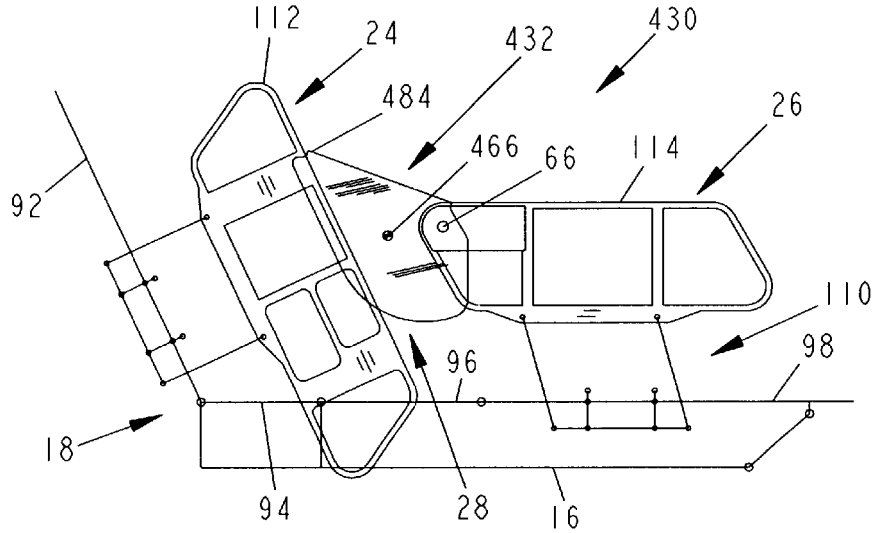
FIG. 21 is a diagrammatic view of the bed in a position in which the head section of the bed deck is pivoted upward and the seat, thigh, and foot sections of the bed deck are flat.
Figure 22:
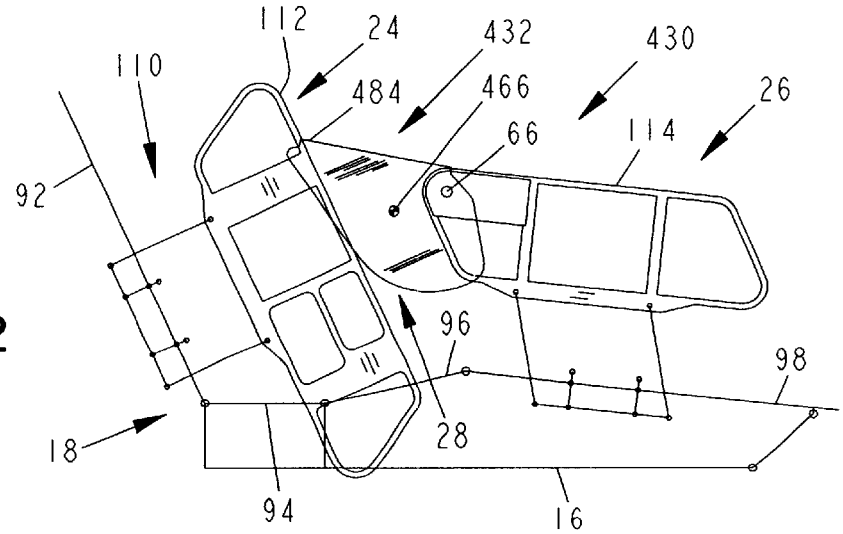
FIG. 22 is a diagrammatic view of the bed in a position in which the head section of the bed deck is pivoted upwardly, as in FIG. 21, and the foot section of the bed deck is slightly elevated.
Figure 23:
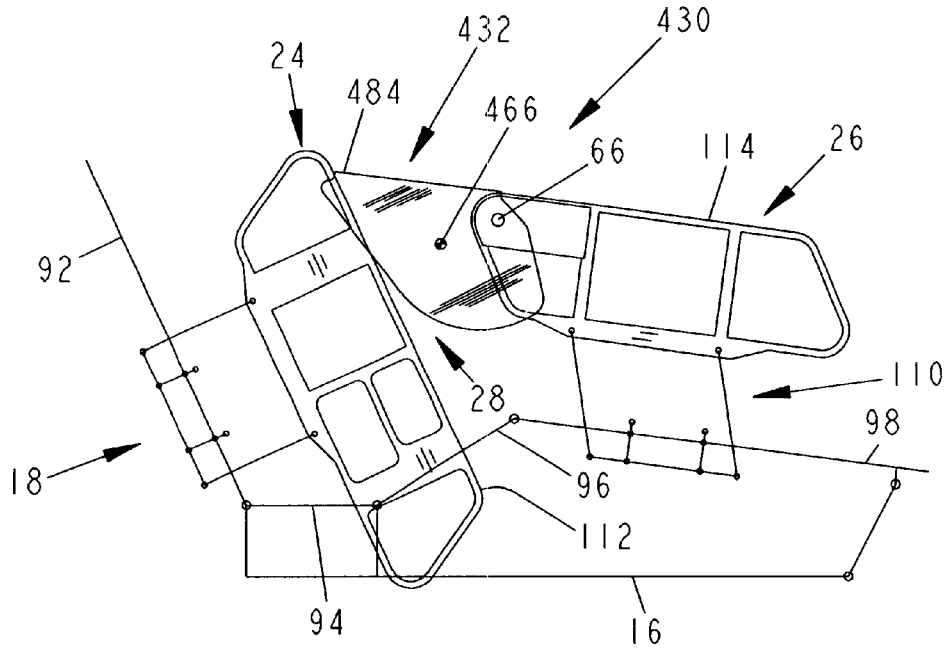
FIG. 23 is a diagrammatic view of the bed in a position in which the head section of bed decks pivoted upwardly, as in FIG. 21, and the foot section of the bed deck is elevated.
Figure 24:
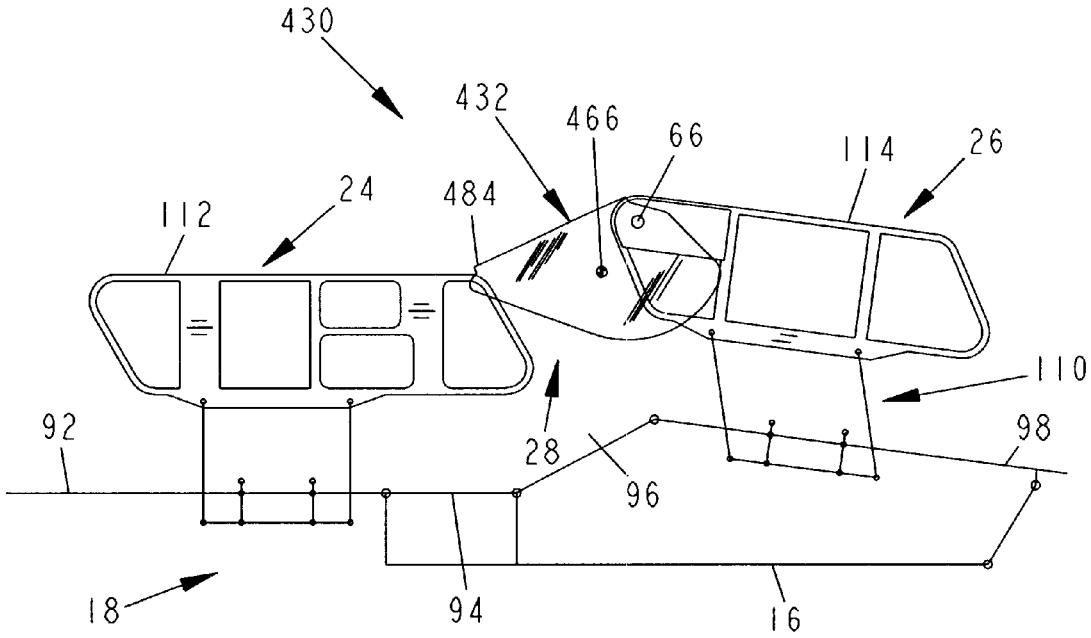
FIG. 24 is a diagrammatic view of the bed in a position in which the foot section of bed deck is elevated, as in FIG. 23, and the head section of the deck is substantially flat.
Figure 25:
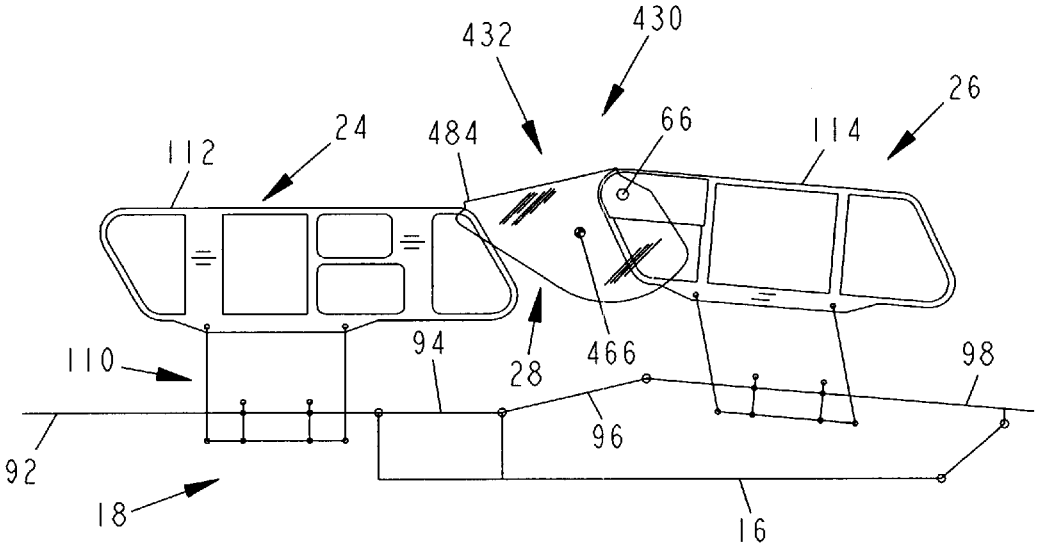
FIG. 25 is a diagrammatic view of the bed in a position in which the foot section of the bed deck is slightly elevated, as in FIG. 22, and the head section of the deck is substantially flat.

Bridge 432 is pivotably coupled to siderail 26 by bridge coupler 434 attached to siderail 26 with each side plate 438, 442 overlapping portions of perimeter rail member 42 and rail strut 46. Bridge 432 is shown as being secured to the bridge coupler 434 by pivot pin 58. Although FIG. 20 depicts top wall 462 of bridge 432 as being parallel to an upper surface 114 of perimeter rail member 42 of siderail 26, it is to be understood that bridge 432 is free to pivot about a horizontal axis of rotation 66 throughout a range of motion which is limited when top wall 462 contacts a portion of perimeter rail member 42 of siderail 26.

Figure 17:
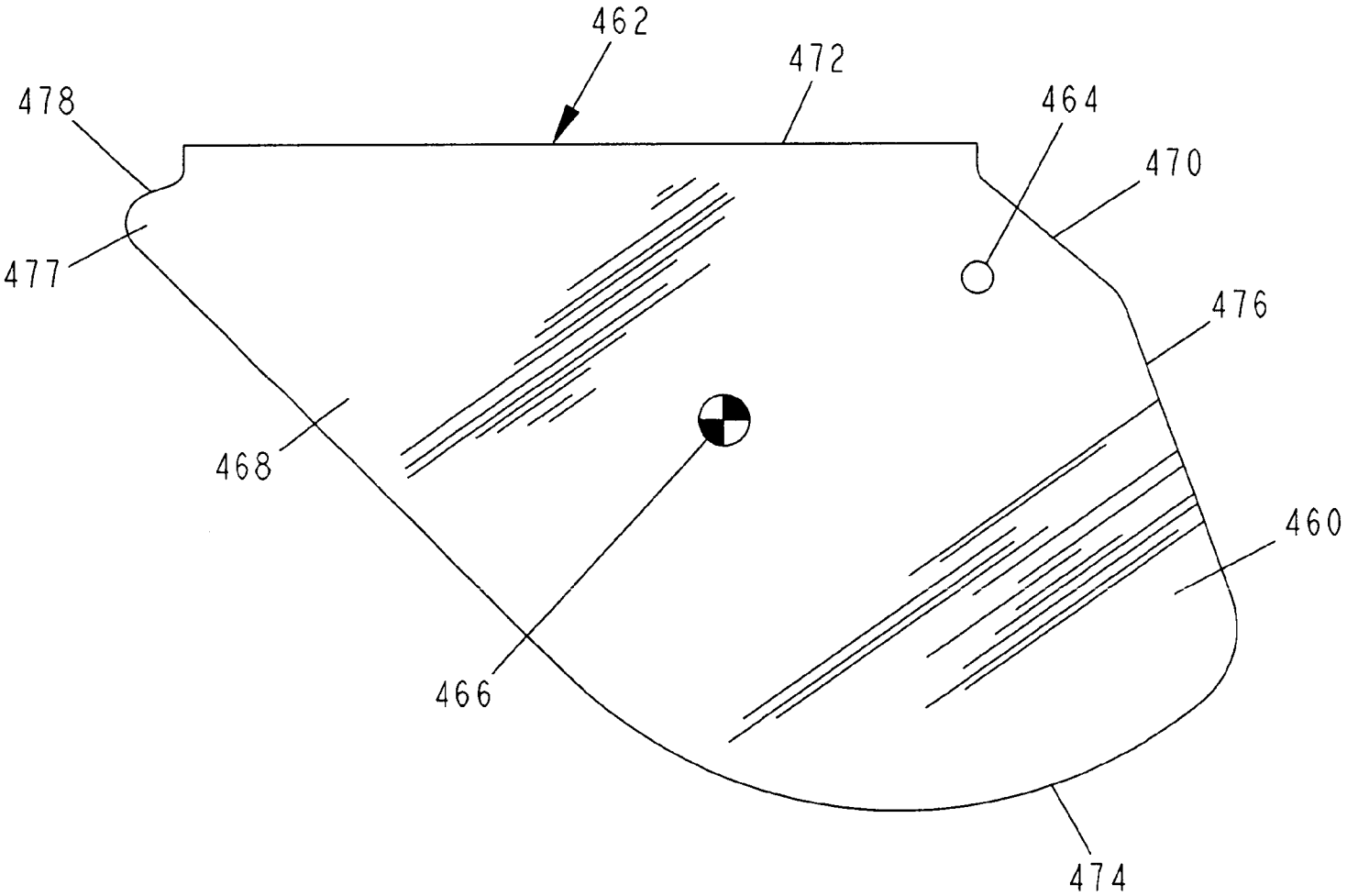
FIG. 17 is a side elevation view of the siderail bridge of FIG. 16.
Figure 19:
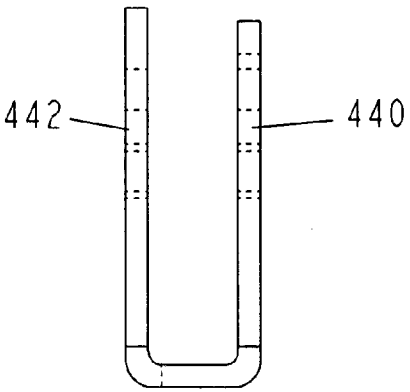
FIG. 19 is an end view of the saddle-shaped member of FIG. 16.
Figure 18:
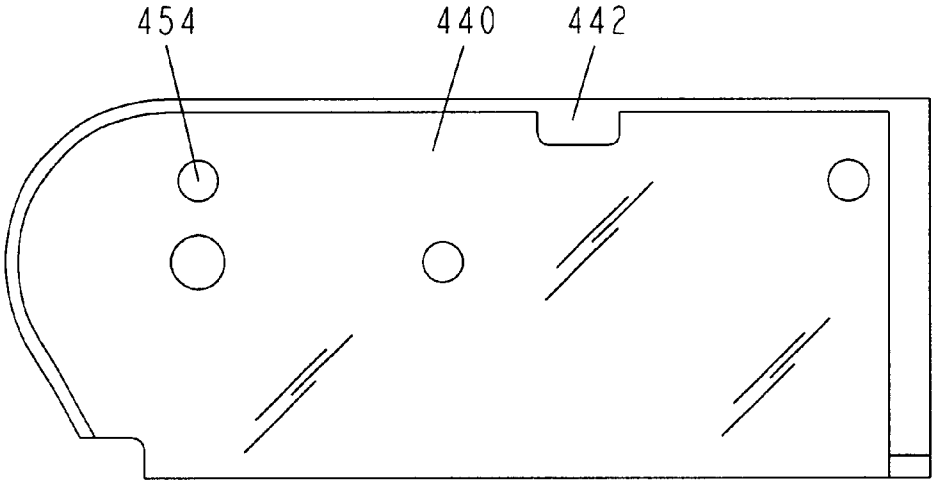
FIG. 18 is a side elevation view of the saddle-shaped member of the bridge coupler of FIG. 16.

As shown in FIG. 17, parallel side walls 460 have a generally wedge shape. Each side wall 460 includes a first straight edge 468, a substantially parallel second straight edge 470, a third straight top edge 472 coupled to top wall 462, a curved lower edge 474 having a substantially uniform radius of curvature or an elliptical curvature, and a fourth straight edge 476 extending from second straight edge 470 to curved edge 474. This general shape permits bridge 432 of the present disclosure to close gaps 28 between adjacent siderails 24, 26 and maintain closure of gap 28 as deck 18 and associated siderails 24 26 are articulated through various positions.

Sidewalls 460 also include a pair of ear portions 477 distant from through holes 464. These ear portions 477 are defined by a portion of straight edge 468 and a curved edge 478 extending from straight edge 468 to top edge 472. Ear portions 477 extend beyond a free end 480 of top wall 462 to define a notch 482 in bridge 432 as best shown in FIG. 16. Thus, free end 480 of top wall 462 terminates at a distal or leading edge 484 which is recessed between or setback from ear portions 477 of sidewalls 460.

Sidewalls 460 and top wall 462 of bridge 432 cooperate to define a channel 486 sized to receive portions of head and foot end siderails 24, 26. Channel 486 has a width that is slightly larger than width 90 of siderails 24, 26. The difference provides clearance between sidewalls 460 and siderails 24, 26 so that bridge 432 pivots freely about foot end siderail 26 and slides and pivots relative to head end siderail 24 during articulation of deck 18.

FIGS. 20–26 diagrammatically depict various exemplary positions of articulated bed 10 having diagrammatic siderails 24, 26 and siderail extender 430 according to the present disclosure pivotably coupled to siderail 26 to close gap 28 between siderails 24, 26. Throughout FIGS. 20–26, common reference numbers are used to identify common elements.

FIGS. 20–25 illustrate the various articulated positions discussed above and shown in FIGS. 9–14. As bed 10 moves through the various positions, bridge 432 moves in the plane defined by siderails 24, 26 and continues to close gap 28. In FIGS. 20–25, bridge 432 is supported at axis of rotation 66 by pin 58 and by leading edge 484, and head and foot end siderails 24, 26 and siderail extender 430 form a set of continuous barriers or restraints.

When moving articulating deck 18 and head and foot end siderails 24, 26 between the positions depicted in FIGS. 20–25, leading edge 484 of bridge 432 of siderail extender 430 pivots and slides along upper surface 112 of head end siderail 24 as bridge 432 pivots about axis of rotation 66 relative to siderail 26. At the same time, ear portions 476 of bridge 432 straddle either side of siderail 24 to guide the movement of leading edge 484 of bridge 432 along upper surface 112 of siderail 24.

The cooperation between the pivoting of bridge 432 about axis of rotation 66 and the pivoting and sliding movement of leading edge 484 along siderail 24 allows siderail extender 430 to extend across and close or bridge gap 28 between head and foot end siderails 24, 26 throughout movement of articulating deck 18 and head and foot end siderails 24, 26 in any of the positions exemplified in FIG. 20–25. Thus, when head end siderail 24 moves relative to foot end siderail 26 due to movement of head end siderail 24, movement of foot end siderail 26, or movement of both head and foot end siderails 24, 26, bridge 432 continues to close gap 28.

As shown in FIG. 20, bridge 432 includes a center of gravity 466. When bridge 432 is positioned over head and foot end siderails 24, 26, center of gravity 466 is positioned between axis of rotation 66 and head end siderail 26. This positioning creates torque on bridge 432 that biases leading edge 484 of bridge 432 into contact with head end siderail 26. Thus, when head and foot end siderails 24, 26 move relative to one another, leading edge 484 in continuously urged into contact with head end siderail 26. Bridge 32 is similarly biased by its center of gravity (not shown). According to alternative embodiments of the present disclosure, other biasing arrangements such as compression springs, torsion springs, elastic straps, or any other biasing arrangement are provided to bias the bridge into contact with the siderails or other barriers.

Figure 26:
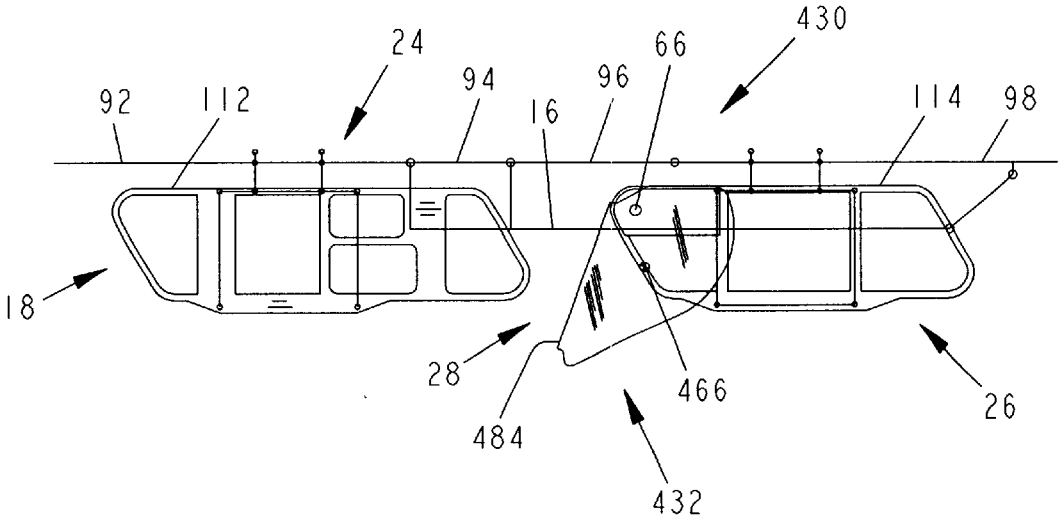
FIG. 26 is a diagrammatic view of the bed with the head and foot siderails lowered to a down position and the bridge spaced apart from the head end siderail.

FIG. 26 is a diagrammatic view of siderail extender 432 attached to siderail 26 which is positioned in a down position beneath foot section 98 of deck 18. To move siderails 24, 26 to the down position, a caregiver lifts upwardly on bridge 432 to move siderail 24 from between sidewalls 460 and lowers either siderail 24, 26 to the down position. When either siderail 24, 26 is moved to the down position while the other siderail 26, 24 is in the up position, leading edge 484 is free to drop without contacting siderail 24. When in the down position, leading edge 484 is positioned below upper surface 114 of foot end siderail 26 and away from upper surface 112 of head end siderail 24. This allows siderail extender 430 to be positioned or stored in a storage position out of the way so that a patient lying on bed 10 is not restrained and so that caregivers can access the patient.

Because leading edge 484 is no longer restrained by head end siderail 24, center of gravity 466 continues to rotate until positioned below axis of rotation 66 where it remains in the storage position until moved by a caregiver. While in the storage position, a caregiver may raise and lower head end siderail 24 without interference with siderail extender 430. Similarly, a caregiver may raise and lower foot end siderail 26 with attached siderail extender 430 without interference from head end siderail 24. When in the storage position, fourth straight edge 476 is substantially parallel to, but slightly below upper surface 114 of perimeter rail member 42. This positioning maintains the clearance between deck 18 and foot end siderail 26 to avoid interference between siderail extender 30 and deck 18 during raising and lower of siderail 26.

Figure 27:
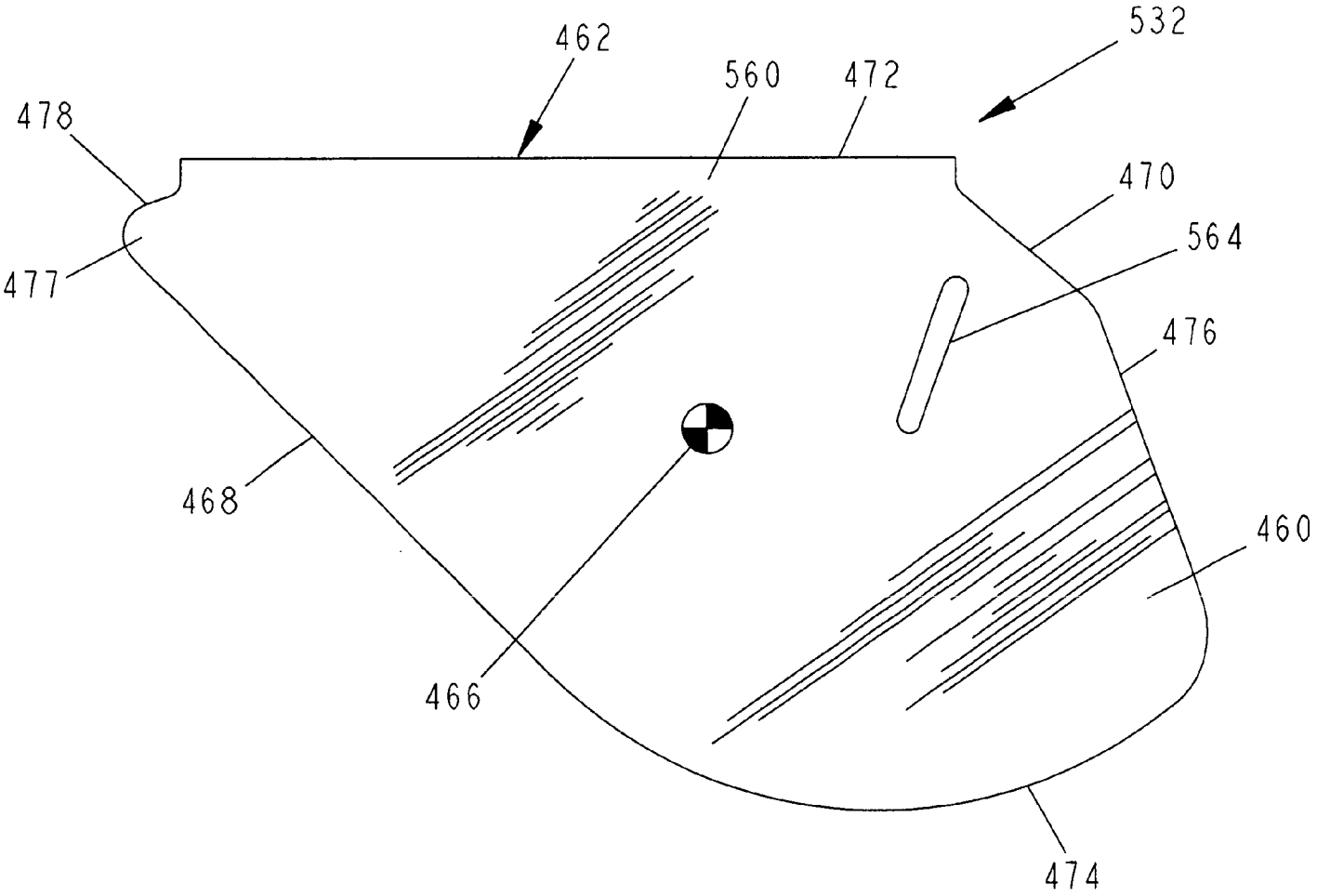
FIG. 27 is a side elevation view of a preferred embodiment bridge formed to include a pin-receiving slot.

Another alternative embodiment bridge 532 is shown in FIG. 27. Bridge 532 is substantially similar to bridge 432. However, bridge 532 is formed to include aligned through slots 564 in each side wall 560 which are provided to receive pivot pin 58.

Figure 28:
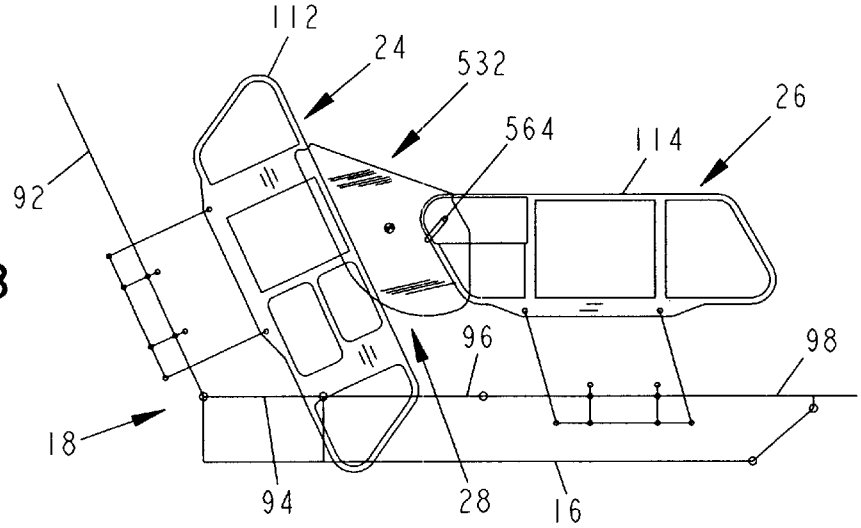
FIG. 28 is a diagrammatic view of the bed in a position in which the head section of the bed deck is pivoted upward and the seat, thigh and foot sections of the bed deck are flat.
Figure 29:
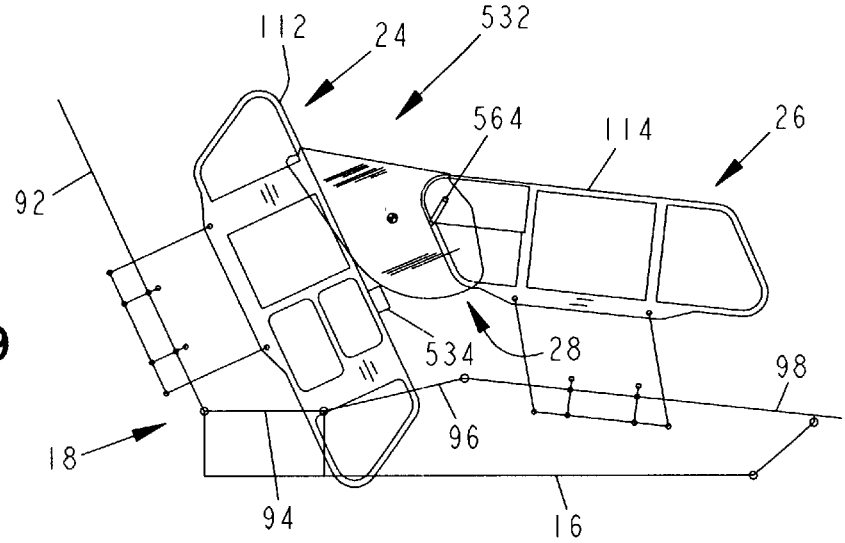
FIG. 29 is a diagrammatic view of the bed in a position in which the head section of the bed deck is pivoted upwardly, as in FIG. 28, and the foot section of the bed deck is slightly elevated showing an object between the bridge and the head end siderail.
Figure 30:
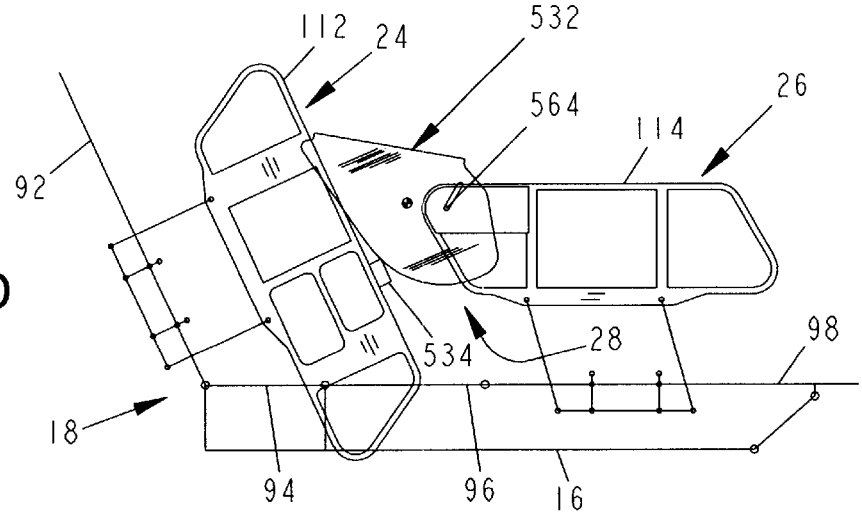
FIG. 30 is a diagrammatic view of the bed similar to FIG. 28 showing the bridge shifted upward by the object due to movement of the bed deck from the position shown in FIG. 29.

Slots 564 permit bridge 532 to slide relative to pin 58 and siderail 26. When deck 18 moves from the position with head section 92 raised and foot section 98 slightly raised, as shown in FIG. 29, to the position with foot section 98 substantially horizontal, as shown in FIG. 28, an object 534 may become positioned between bridge 532 and headend siderail 24. When this occurs, pin 58 slides along slots 564 from a position near the top of slots 564, as shown in FIG. 29, to the bottom of slots 564 as shown in FIG. 30.

Although the invention has been described in detail with reference to certain illustrated embodiments, variations exist within the scope and spirit of the invention as described and as defined in the following claims.

What is claimed is:

1. A bed comprising a bedframe, a first barrier coupled to the bedframe, a second barrier coupled to the bedframe, the second barrier cooperating with the first barrier to define a gap therebetween, a mattress positioned on the bedframe, and a third barrier pivotably coupled to the first barrier to pivot about a horizontal axis of rotation, the third barrier extending between the first and second barriers to close the gap therebetween.

2. The bed of claim 1, wherein first barrier is a siderail and the second barrier is a siderail.

3. The bed of claim 1, wherein the first barrier is configured to move relative to the second barrier and the third barrier slides relative to the second barrier as the first barrier moves relative to the second barrier.

4. The bed of claim 1, wherein third barrier has a center of gravity positioned between the axis of rotation and the second barrier.

5. The bed of claim 1, wherein the third barrier is positioned over the first and second barriers.

6. Thereof claim 5, wherein the third barrier is saddle-shaped.

7. The bed of claim 6, wherein the third barrier includes a first wall, a second wall substantially parallel with the first wall, and a third wall extending between the first and second walls.

8. The bed of claim 7, wherein the third wall is positioned over the first and second barriers.

9. The bed of claim 7, wherein the third wall contacts the second barrier.

10. The bed of claim 7, wherein first and second walls have a curved edge having a uniform radius of curvature.

11. The bed of claim 1, wherein the first barrier is configured to move relative to the second barrier and the third barrier remains in contact with the second barrier during movement of the first barrier relative to the second barrier.

12. The bed of claim 1, wherein the first and second barriers cooperate to define a plane and the third barrier pivots in the plane defined by the first and second barriers.

13. The bed of claim 1, wherein the third barrier includes a top edge extending between the first and second barriers and a curved edge having a uniform radius of curvature.

14. A bed comprising a bedframe, a first barrier coupled to the bedframe, a second barrier coupled to the bedframe, the first and second barriers cooperating to define a gap therebetween, a mattress positioned on the bedframe, and a third barrier coupled to the first barrier to extend between the first barrier and the second barrier to close the gap defined therebetween, the third barrier being biased into contact with the second barrier.

15. The bed of claim 14, wherein the third barrier is pivotably coupled to the first barrier.

16. The bed of claim 15, wherein the third barrier pivots about a horizontal axis of rotation.

17. The bed of claim 15, wherein the third barrier includes a center of gravity positioned between the axis of rotation and the second barrier to provide the biasing.

18. The bed of claim 14, wherein the first barrier is configured to move relative to the second barrier and the bias of the third barrier maintains contact of the third barrier with the second barrier during movement of the first barrier relative to the second barrier.

19. The bed of claim 14, wherein at least one of the first and second barriers are configured to move between an up position and a down position and the third barrier is configured to be moved against the bias to permit the at least one of the first and second barriers to move between the up and down positions.

20. The bed of claim 19, wherein the bias of the third barrier moves the third barrier to a storage position spaced apart from the second barrier when one of the first and second barriers is in the down position.

21. The bed of claim 20, wherein the third barrier is pivotably coupled to the first barrier to pivot about an axis of rotation and the third barrier includes a center of gravity positioned under the axis of rotation when the third barrier is in the storage position.

22. A bed comprising a bedframe, a first barrier coupled to the bedframe, a second barrier coupled to the bedframe, the first barrier being configured to move relative to the second barrier, the first and second barriers cooperating to define a gap therebetween, a mattress positioned on the bedframe, and a rigid third barrier positioned to move relative to the first barrier during movement of the first barrier relative to the second barrier, the rigid third barrier being positioned to close the gap defined by the first and second barriers during movement of the first barrier relative to the second barrier.

23. The bed of claim 22, wherein the rigid third barrier is saddle-shaped.

24. The bed of claim 22, wherein the first barrier includes an inner surface facing toward the mattress, the second barrier includes an inner surface facing toward the mattress, and the rigid third barrier includes a wall positioned adjacent to the inner surfaces of the first and second barriers.

25. The bed of claim 22, wherein the rigid third barrier pivots relative to the first barrier during movement of the first barrier relative to the second barrier.

26. The bed of claim 25, wherein the rigid third barrier pivots relative to the second barrier as the first barrier moves relative to the second barrier.

27. The bed of claim 22, wherein the rigid third barrier is in sliding contact with the second barrier during movement of the first barrier relative to the second barrier.

28. The bed of claim 27, wherein the rigid third barrier pivots relative to the second barrier during movement of the first barrier relative to the second barrier.

29. A bed comprising a bedframe, a first barrier coupled to the bedframe, a second barrier coupled to the bedframe, the first barrier being configured to move between first and second positions relative to the second barrier, the first and second barriers cooperating to define a gap therebetween, a mattress positioned on the bedframe, and a third barrier positioned to slide relative to the second barrier as the first barrier moves relative to the second barrier, the third barrier being positioned to close the gap defined by the first and second barriers during movement of the first barrier relative to the second barrier.

30. The bed of claim 29, wherein the third barrier pivots relative to the second barrier during movement of the first barrier relative to the second barrier.

31. The bed of claim 30, wherein the third barrier pivots relative to the first barrier during movement of the first barrier relative to the second barrier.

32. The bed of claim 29, wherein the second barrier includes a first end and a second end spaced apart from the first end, the third barrier is positioned nearest the first end when the first barrier is in the first position and nearest the second end when the first barrier is in the second position.

33. The bed of claim 29, wherein the third barrier is positioned over the first and second barriers.

34. The bed of claim 33, wherein the third barrier slides over a top surface of the second barrier.

35. A bed comprising a bedframe including a head end and a foot end, a first siderail, the first siderail having a first end positioned nearest the head end of the bedframe and a second end spaced apart from the first end, a second siderail, the second siderail having a first end positioned nearest the foot end of the bedframe and a second end spaced apart from the first end of the second siderail, the first and second siderails cooperating to define a siderail length measured from the first end of the first siderail to the first end of the second siderail, the first and second siderails cooperating to define a gap therebetween, a mattress positioned on the bedframe, and a barrier positioned over the first and second siderails to close the gap defined therebetween, the third barrier having a length less than the siderail length.

36. The bed of claim 35, wherein the barrier is rigid.

37. The bed of claim 35, wherein the barrier is pivotably coupled to one of the first and second siderails.

38. The bed of claim 37, wherein the first siderail is configured to move relative to the second siderail and the barrier is in sliding contact with one of the first and second siderails during movement of the first siderail relative to the second siderail.

39. The bed of claim 35, wherein the first siderail is configured to move relative to the second siderail and the barrier is in sliding contact with one of the first and second siderails during movement of the first siderail relative to the second siderail.

40. The bed of claim 35, wherein the barrier includes a saddle-shaped bridge positioned over the first and second siderails.

41. A bed comprising a bedframe, a first barrier coupled to the bedframe, a second barrier coupled to the bedframe, the first barrier being configured to move relative to the second barrier, the first and second barriers cooperating to define a gap therebetween, a mattress positioned on the bedframe, and a third barrier pivotably coupled to the first barrier to pivot relative to the first barrier during movement of the first barrier relative to the second barrier, the third barrier being positioned to close the gap defined by the first and second barriers during movement of the first barrier relative to the second barrier.

42. The bed of claim 41, wherein the third barrier pivots relative to the second barrier during movement of the first barrier relative to the second barrier.

43. The bed of claim 42, wherein the third barrier is in sliding contact with the second barrier during movement of the first barrier relative to the second barrier.

44. The bed of claim 41, wherein the third barrier is in sliding contact with the second barrier during movement of the first barrier relative to the second barrier.

45. Abed comprising a bedframe, a first barrier defining a gap adjacent thereto, the barrier including an opening therethrough, a mattress positioned on the bedframe, and a second barrier including a bridge positioned to extend from the first barrier to close the gap and a coupler configured to couple the bridge to the first barrier, the coupler including a first plate sized to fit over the opening, a second plate sized to fit over the opening opposite the first plate, and a rigid fastener coupling the first plate to the second plate.

46. The bed of claim 45, wherein the first barrier includes a strut extending through the opening and the first and second plates are positioned on opposite sides of the strut.

47. The bed of claim 46, wherein the first and second plates are positioned adjacent the strut.

48. A bed comprising a bedframe, a first barrier defining a gap adjacent thereto, the barrier including an opening therethrough, a mattress positioned on the bedframe, and a second barrier including a bridge positioned to extend from the first barrier to close the gap and a coupler configured to couple the bridge to the first barrier, the coupler including a first plate sized to fit over the opening, a second plate sized to fit over the opening opposite the first plate, a fastener coupling the first plate to the second plate, and a plug sized to fit within the opening between the first and second plates.

49. The bed of claim 48, wherein the first plate and the plug are integral.

50. A bed comprising a bedframe, a first barrier defining a gap adjacent thereto, the barrier including an opening therethrough, a mattress positioned on the bedframe, and a second barrier including a bridge positioned to extend from the first barrier to close the gap and a coupler configured to couple the bridge to the first barrier, the coupler including a first plate sized to fit over the opening, a second plate sized to fit over the opening opposite the first plate, and a fastener coupling the first plate to the second plate, the first plate being integral with the second plate.

* * * * *